US006142364A

United States Patent [19]

Laker et al.

[11] Patent Number: 6,142,364

[45] **Date of Patent: *Nov. 7, 2000**

[54] OPENING MEANS FOR GABLE TOP CONTAINER

[75] Inventors: Jonathan Paul Laker; Kirk Anthony Laker, both of Felixstowe, United Kingdom

[73] Assignee: Easycarton Limited, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/945,462

[22] PCT Filed: May 21, 1996

[86] PCT No.: PCT/GB96/01221

§ 371 Date: Feb. 6, 1998

§ 102(e) Date: Feb. 6, 1998

[87] PCT Pub. No.: WO96/37412

PCT Pub. Date: Nov. 28, 1996

[30] Foreign Application Priority Data

| | | | |
|---|---|---|---|
| May 23, 1995 | [GB] | United Kingdom | 9510331 |
| Oct. 10, 1995 | [GB] | United Kingdom | 9520666 |
| Oct. 10, 1995 | [GB] | United Kingdom | 9520688 |
| Oct. 10, 1995 | [GB] | United Kingdom | 9520689 |
| Oct. 13, 1995 | [GB] | United Kingdom | 9520785 |

[51] Int. Cl.[7] ..... B65D 93/00

[52] U.S. Cl. ..... 229/160.2; 229/213; 229/249; 229/125.42; 229/917

[58] Field of Search ..... 229/160.2, 125.42, 229/213, 917, 214, 249, 920, 924, 87.05

[56] References Cited

U.S. PATENT DOCUMENTS

| | | | |
|---|---|---|---|
| 2,470,199 | 5/1949 | Vivian . | |
| 2,687,840 | 8/1954 | Innes . | |
| 3,204,850 | 9/1965 | Wilcox | 229/160.2 |
| 3,520,464 | 7/1970 | Pugh, Sr. . | |
| 4,821,950 | 4/1989 | Sanchez et al. . | |
| 4,874,126 | 10/1989 | Miller . | |
| 4,883,222 | 11/1989 | Fujisawa | 229/160.2 |
| 4,946,041 | 8/1990 | Poole | 229/125.42 X |
| 4,982,845 | 1/1991 | Prascak et al. | 229/87.05 |
| 5,333,735 | 8/1994 | Focke et al. | 229/87.05 X |
| 5,353,985 | 10/1994 | Nagelie et al. | 229/123.1 |
| 5,516,037 | 5/1996 | Okamoto et al. | 229/160.2 |

FOREIGN PATENT DOCUMENTS

| | | | |
|---|---|---|---|
| 0689024 | 3/1953 | United Kingdom | 229/125.42 |
| 2253608 | 9/1992 | United Kingdom | 229/160.2 |

*Primary Examiner*—Stephen P. Garbe
*Assistant Examiner*—Tri M. Mai
*Attorney, Agent, or Firm*—Charles D. Gunther, Jr.

[57] ABSTRACT

The invention relates to a boxed end openable container having means whereby a separating force can be applied transversely to the line of a linear ridge seal of the scaled container at or adjacent that portion of the linear ridge seal located intermediate the apexes of the V folds in the gable ends of the sealed container so as to cause that portion of the ridge seal to separate and subsequently permit substantially the whole length of the linear ridge seal to separate and cause on the tent side walls of the sealed container to move transversely with respect t the line of the linear ridge seal to form an outlet to the container. Preferably, the container is provided with a pull tab secured to a tent wall and/or the ridge of the assembled container. Preferably, the pull tab has laterally extending portions which are incorporated into the ridge structure. The invention also provides a method for opening a boxed end openable container, a blank for use in the manufacture of the container and a pull tab for use in the invention.

10 Claims, 14 Drawing Sheets

OPENING MEANS FOR GABLE TOP CONTAINER

The present invention relates to a container, notably a carton having a pull tab to assist opening of a sealed end of the carton.

BACKGROUND TO THE INVENTION

Many materials, notably fluids such as milk or fruit juices, are put up in sealed containers for transport and storage prior to use when the container is opened and the contents discharged. Many forms of containers are used for this purpose, but one form is a thin walled carton made from a thin card or plastic sheet material and having a generally squared or rectangular cross-section and a cuboid or brick-like overall shape. The contents of such a container are typically fed to the container through an open top end of the container, the other end being having been closed by folding over the basal portion of the side walls to form a boxed end to the container. When the desired amount of material has been fed to the container, the open top of the container is closed by forming transversely directed V folds in the upper portions of two opposed side walls, with the apexes of the Vs directed inwardly towards one another. This has the effect of bringing the top portions of the other two side walls of the container together to form a tented top to the container having a ridge lying along the line of indentation of the V folds. The ridge is then heat sealed or otherwise processed so as to secure together the opposed faces of the upper portions of the V folded and other side walls in a single linear transverse strip seal closure to the container, at least the major portion of the closure being located within the overall cross-sectional plan area of the container.

The sealed ridge is often then folded down about a transverse fold line located extending across approximate-ly the midpoint of one of the side walls of the tented top, so as to form a flat boxed end to the container. In some forms of such a closure, a tape which can be wire-reinforced is included in the line of the ridge, for example during folding over of the ridge material. This tape extends beyond the ends of the ridge to provide extensions which can be bent over to secure the folded down ridge in position by engaging the free ends of the tape under the lip formed along the edge of the boxed end where the V folded portion of the container wall is indented. Alternatively, the free ends of the extensions can be adhered or otherwise secured to the side walls of the container once the ridge has been folded down to form a boxed end to the container.

For convenience, the following terms will have the following means herein:

- boxed end openable containers are containers of the above described general type and will be referred to herein as such containers;
- ridge seal will be used to denote the transverse linear seal between the opposed faces of the top end portions of the side walls of the container;
- ridge will be used to denote the exposed top edge of the ridge seal or the edges of the wall material which has been brought together prior to forming the ridge seal;
- ridge structure will be used to denote the structure formed by bringing together the top end portions of the gabled and tent side walls of the container and which are secured together by adhesion between opposing faces at the interface between those opposing faces to form the ridge;
- gabled end will be used to denote the structure formed at the top end of the container by indenting the upper portions of two opposed side walls of the container to form the ridge to that end of the container;
- tented end will be used to denote the end of the container with the ridge in the raised position either before or after forming the ridge seal;
- gabled side walls will be used to denote the upper portions of the two opposed side walls of the end of the container which have been indented by forming a V or other axial fold in the upper portion of the side wall so that the wall is collapsed laterally inwardly to form the gabled end to the container;
- tent side walls will be used to denote the two opposed side walls of the sealed top which extend between the gabled side walls of the gabled end of the container;
- wet wall will be used to denote a wall of the container which is to be in contact with the contents of the container, including the upper portions of such walls which are to be incorporated into the ridge seal;
- dry wall will be used herein to denote a wall of the container which is not in contact with the contents of the container, including the upper portions of such walls which are to be incorporated into the ridge seal.

To open such a boxed end openable container, the seal at the interface between the opposing dry wall surfaces of the V fold at one end of the linear ridge seal is separated. This forms a pair of wings in the gabled end so that the plan view configuration from above of the ridge seal to the container adopts a Y shaped configuration in place of a single line seal. The top edges of the wings forming the head of the Y remain sealed together. The wings are then bent backward to lie in line with each other, ie. so that the plan view configuration from above of the ridge seal adopts a T shaped configuration with the wings forming the head of the T. The free ends of the wings are then pressed inwardly towards the centre line of the upright of the T to apply a separating force transverse to the line of the seal at the intersection of the head and the upright of the T. This causes the seal between the opposed faces of the wet walls at the top edges of the container to separate at this intersection and to form an opening through which the contents of the container can be discharged. In some cases it may be desired to bend the wings beyond the in-line configuration so as to enhance the separating force applied to the seal at the intersection upon the application of pressure to the free ends of the wings.

However, separation of the seal is often incomplete and/or the wings collapse so that the user cannot continue to apply the separating force to the seal. It is therefore usually necessary for the user to insert a finger tip into the initial opening formed at the intersection to assist full separation of the seal between the faces of the wet walls to allow the V fold in the wall of the container to be unformed and then inverted to form a spout outlet to the container.

In many cases the initial separation of the seal between the wet walls at the intersection is insufficient to form an aperture into which the user can insert a finger tip. It is then necessary for the user to pinch the dry wall material in the unfolded gabled end wall of the container in the region of the V fold and try to pull the wall outwardly to assist separation of the seal. Such separation of the seal may occur abruptly, causing spillage of the contents of the container, and the need for such additional operations to separate the ridge seal is inconvenient.

Notwithstanding these problems in forming the opening to the container, the boxed end openable container provides a simple and effective container for the storage and transport of a wide range of fluids and remains widely used.

Many attempts have been made to resolve the difficulties in opening such containers. Thus, it has been proposed in British Patent Application No 2 253 608 A1 to form a slit in one of the gabled end walls and to apply a removable seal strip over the slit. The container is opened by separating the ridge seal and bending the wings of the ridge seal backwards to the T configuration as described above for a conventional such container. This has the effect of unfolding the gabled end wall and of exposing the seal strip. Removing the seal strip not only exposes the slit, but also folds the gabled end wall outwardly so as to form a spouted opening to the container through which the contents of the container can be discharged. A pull tab can be applied externally to the gabled end wall axially below the seal strip which can also be used to aid deployment of the gabled end wall.

It has also been proposed in British Patent No 1 190 131 to provided two pull tabs, one at each edge of an adhesive tape which is applied over a line of weakness in a gabled end wall of the sealed container. The end of the ridge seal is separated and the wings of the ridge pushed backwards to the T configuration as with a conventional such container to unfold the gabled end wall. The adhesive tape is removed by pulling on either or both of the pull tabs. Removal of the tape causes rupture of the gabled end wall material along the line of weakness and deploys the severed wall as a spout outlet to the container.

Such proposals require the formation of a slit or line of weakness in the wall of the container. This can result in accidental premature rupturing of the container wall as well as requiring the addition of extra components during the manufacture of the sealed container.

It has been proposed in U.S. Pat. No. 4,821,950 to provide the ridge seal with a string pull which is located between opposed faces of the wet walls of the container and extends into the container. Application of tension to the exposed end of the string pull causes the string to move along the line of the seal to separate the opposing wet wall portions of the ridge seal from one another and to deploy the gabled end wall as a spout. Such a device suffers from the problems of accurate location and securing of the pull string within the ridge seal and of contamination of the contents of the container as they are discharged due to contact with the exposed portion of the pull string.

It has also been proposed in U.S. Pat. No. 4,883,222 to form an external pull tab by axially extending the material from which the gabled end wall is to be formed and folding over that extension so that it lies within the gabled end structure. To open such a container, the ridge seal is partially separated to the T plan configuration as with a conventional such container. This exposes the free end of the extension of the gable end wall and application of tension to that free end applies a separating force to the ridge seal to separate the ridge seal at the head of the T and deploy the gable end wall as the spouted outlet to the container. However, the strength of most materials from which the container is constructed is too low to survive the stresses imposed on the extension and the extension tears along the line of the ridge in the head of the T before the seal is separated. If the strength of the ridge seal is reduced to permit it to separate before the wall material tears, the container is liable to catastrophic premature rupturing of the ridge seal.

This patent and U.S. Pat. No. 4,874,126 also describe an alternative version in which a separate pull tab is secured to the external face of the top portion of a gable end wall and the foot of the pull tab incorporated into the ridge seal between the opposing dry wall face of the V fold. The pull tab is exposed when the ridge seal in the gabled end is partially separated to adopt the T configuration as described above. When the pull tab is pulled, it should cause the ridge seal in the head of the T to separate. However, the tension required to separate the ridge seal is usually far greater than the separation force of the adhesive or other bond by which the pull tab is secured to the external face of the gabled end wall. Therefore, the pull tab separates from the ridge material before any separation of the ridge seal itself takes place. Such designs are therefore impractical. Reduction of the strength of the ridge seal to avoid separation of the pull tab from the wall material will again lead to catastrophic premature rupturing of the ridge seal.

The above proposals provide means for separating the ridge seal within the gabled end structure of the sealed container and require that the seal between opposing dry walls of the indented gable end at one end of the linear ridge seal first be separated to form the wings described above so that the linear seal adopts the T configuration before the seal between the wet faces in the head of the T can be separated. This is cumbersome and requires a number of operations to be carried out.

It has been proposed in British Patent Application No 2 010 212 A1 to apply two pull tabs within the end portion of the ridge seal. These pull tabs are pulled laterally to separate the opposed faces of the wet walls in the ridge seal whilst in the linear configuration without the need to form the ridge seal into a T configuration. However, such an assembly requires that the manufacture of the container be modified to permit the ends of the pull tabs to be inserted into the open end of the container during manufacture and held accurately in position at one end of the length of the ridge seal during its formation. Furthermore, a gabled end structure is not formed in this end of the ridge line of the container and the ridge extends beyond the side of the container. This protruding portion of the ridge requires to be folded down around the top corner of the sealed container against a side wall of the container to form a boxed end suitable for storage and transport. This requires extensive modification of the machinery to assemble, fold and seal the container and to fold the resultant sealed container.

It has also been proposed in U.S. Pat. No. 5,067,613 to provide one of the tent side walls of the tented end of the container with a tear out portion having a pull tab which extends beyond the line of the ridge seal. The tear out portion carries with it an accordion fold of material which has been incorporated within the interior of the container. As the tear out portion is pulled laterally away from the line of the ridge seal by the pull tab, the tent side wall of the container ruptures to allow the accordion fold to unmake so as to deploy the folded material as a spout. After the desired amount of the contents of the container has been discharged through the resultant spouted aperture, the aperture can be closed by reforming the accordion folds so as to collapse the spout against the remainder of the tent side wall of the container. Part of the accordion fold engages under the lip of the remainder of the tent side wall to latch the accordion fold in position. Such a structure is complex and adds considerably to the cost of the container. Furthermore, since the upstanding pull tab which is required to enable a user to deploy the spout is exposed to dirt and other contamination during storage and transport of the container prior to use, contamination of the contents of the container as they flow over the spout will occur. This proposal relies upon rupture of the tent side wall and does not cause any separation of the ridge seal itself.

Despite all these earlier proposals, no satisfactory solution to the problem of opening a conventional boxed end openable container has yet been found and none of these earlier proposals have been adopted in practice. Present proposals for providing discharge means to a such container rely upon the insertion of a plastic component through an aperture in a tent side wall, which component has a screw or snap lid to a bore through the component to provide a re-sealable outlet to the container. Such a component add costs and complexity to the manufacture and filling of the container and does to require any separation of the ridge seal of the sealed container.

We have now found that such a container can be readily opened by applying a separation force laterally to the ridge seal whilst in its linear configuration in the region of the opposed apexes of the V folds and separating the opposed faces of the wet walls in this region of the ridge seal laterally from one another. Surprisingly, this method of opening the container is remarkably easy to perform and is less prone to partial separation of the ridge seal than the previous methods which open the seal within the gabled end structure of the container. Furthermore, the method of the invention does not require complex additional components or changes to conventional container assembly, filling and closing techniques or machinery. In a particularly preferred embodiment, the lateral separation force is applied to the linear ridge seal by means of a pull tab secured externally to a tent side wall and/or to the side wall of the ridge construction. The pull tab can readily be incorporated into the structure of the container with little or no modification to the container manufacturing and filling processes, notably where the pull tab is applied to the flat blank of card or plastic from which the container is to be formed. Thus, the invention can be applied to a container which is assembled, filled and sealed using conventional techniques and machinery.

SUMMARY OF THE INVENTION

Accordingly, the present invention relates to a boxed end openable container having means whereby a separating force can be applied transversely to the line of the linear ridge seal of the sealed container whilst still in the substantially linear configuration at that portion of the linear ridge seal located intermediate or adjacent the apexes of the V folds in the gable ends of the sealed container so as to cause that portion of the ridge seal to separate. The application of further separating force enables progressive separation of substantially the whole length of the linear ridge seal and causes at least the upper portion of one of the tent side walls of the sealed container to move transversely with respect to the line of the linear ridge seal to form an outlet to the container.

Surprisingly, we have found that, if the lateral ends of the linear ridge seal are deflected transversely to its length, eg. backwards, the centre portion of the seal bows in the opposite direction, eg. forwards, and that the force required to separate the bowed ridge seal in the portion intermediate or adjacent the apexes of the V folds is less than that required to separate the un-bowed seal. This bowing of the ridge seal is usually achieved by or is coincident with outward bowing of the tent wall adjacent the mid-point of the length of the ridge seal. As a result, it is possible to cause separation of the ridge seal at this portion without the need to separate the seals between the opposing dry wall surfaces of the V folds at the ends of the ridge seal as hitherto when forming the T configuration of prior opening methods.

Accordingly, the invention also provides a method for opening a boxed end openable container, which method comprises applying a force transverse to the line of the ridge seal at each lateral end of the linear ridge seal whilst still in its substantially linear configuration so as to cause the linear ridge seal to bow in the opposite direction; and applying a separation force transversely to the bowed ridge seal intermediate the opposed V folds.

Application of the separation force to the bowed ridge seal whilst still in its substantially linear configuration causes progressive separation of substantially the whole length of the seal to form a spout outlet to the container more consistently than with the hitherto proposed designs of container and their methods of opening.

The separation force can be applied to the ridge seal by applying a compression force parallel to the line of the ridge seal either to the ridge seal itself or to either or both of the tent side walls adjacent the ridge seal. Where the lateral separation force is applied as described above by applying a compressive force to the ends of one exposed side wall of the ridge seal, it may be preferred to provide reduced adhesion between the opposed faces of the dry walls for at least a portion, typically from 10 to 50%, of the indentation of the V folds within the ridge seal to assist bowing of a tent wall away from the line of the ridge seal and thus assist separation of the ridge seal itself. Such reduced adhesion can be achieved by, for example, the use of a reduced amount of adhesive applied to the opposing surfaces, by the use of a wall material which has a thinner coating of plastic where a plastic coated or laminated card is used for the container wall material, or by the presence of an abhesive material between the opposing dry wall surfaces, or a combination of these. It is preferred to apply the separation force at a point below the foot of the ridge seal by applying a transverse force to the exposed opposed edges of one tent side wall of the sealed container, for example between 10 and 40% along the exposed lateral edge of the tent side wall from the foot of the ridge seal towards the point at which the gable end structure merges into the main body of the container. As indicated below, it is preferred to provide fold lines, for example score or crease lines, in the material of the tent side wall and the ridge seal to assist bowing of the tent side wall and ridge seal. This bowing of the tent side wall, we believe, applies at least part of the transverse separation force to the base of the ridge seal causing upward peel separation of the seal rather than shear separation. We have found that this markedly facilitates separation of the adherent wet wall surfaces within the ridge seal.

Alternatively, the separation force can be applied by means of a pull tab provided to or affixed to either of the tent side walls and/or the exposed side walls of the ridge seal. The user grasps the exposed free end of the pull tab and pulls transversely to the line of the ridge seal to apply the separation force to the linear ridge seal. It is preferred to bow the ridge seal towards the direction of the pull tab to assist initial separation of the ridge seal, but this will often not be necessary. It will be appreciated that more than one pull tab can be provided symmetrically disposed along the length of the ridge seal about the mid-point of the length of the ridge seal. However, it is preferred to provide a single pull tab located substantially upon the centre line of the ridge seal. The container can be provided with a single pull tab located to one side of the ridge seal of the sealed container. If desired, a second pull tab can be provided on the other side of the ridge seal to enable a user to open the container by pulling on both pull tabs in opposite directions. For convenience, the invention will be described hereinafter in terms of a single pull tab provided to one side of the ridge seal.

Such a pull tab is preferably located at or adjacent, typically within 5 to 10% of the length of the ridge seal to either side of, the axial line passing through the portion of the linear ridge seal located between the apexes of the V folds in the gable ends of the sealed container, which will itself usually be located at the mid-point along the length of the ridge seal.

The pull tab can be formed as an axial extension of the tent side wall extending beyond the top of the ridge seal, so that it is formed integrally with a tent wall of the container structure. However, the pull tab will then have a tear strength similar to that of the container wall material and may be liable to tearing if excessive force is applied to it. Furthermore, such a pull tab may be exposed to dirt, oil and other contamination during transport and storage. Such contamination could transfer to the contents of the container as they are discharged and contact the pull tab. This may limit the types of material for which the container could be used to those, for example detergent fluids or powders, where contamination is not deleterious.

It is therefore preferred to form the pull tab as a separate component which is secured at the desired location to the exposed side wall of the ridge seal and/or to the adjacent tent side wall. The use of a separate component allows the use of materials other than those from which the container walls are made and flexibility in the location and method of securing the pull tab to the container.

It is also preferred that the pull tab be attached to the side tent wall at a point at or adjacent the foot of the ridge seal so that it causes bowing of the tent side wall and enhances the upward peel force applied to the foot of the ridge seal. Typically, the ridge has a height as measured in the axial dimension of the container which is from 10% to 100% of the length of the remainder of the tent side wall, as measured in the same direction, lying below the ridge seal and the pull tab is secured to the tent side wall within approximately the top third of this remainder of the tent side wall. Preferably, the pull tab is secured to the tent side wall axially substantially in register with the mid-point of the ridge seal and from 1 to 15, notably 2 to 5, mms below the foot of the ridge seal so that tension applied to the pull tab applies the separation force to the foot of the ridge seal and initially causes an upward peeling separation of the opposed wet wall faces of the ridge seal.

Accordingly, from a preferred embodiment, the invention provides a boxed end openable container having means whereby a separating force can be applied transversely to the line of the ridge seal of the sealed container, preferably whilst still in its substantially linear configuration, characterised in that a pull tab is located externally of the container and is provided to at least one of the tent side walls and/or the side walls of the ridge seal of the sealed container, preferably at or adjacent the foot of the linear ridge seal, and axially substantially in register with that portion of the ridge seal located intermediate or adjacent the apexes of the V folds in the gable ends of the sealed container, whereby application of tension to the pull tab is adapted to apply a lateral separation force to the ridge seal and to cause the tent side wall of the sealed container in its integral state to move transversely with respect to the line of the linear ridge seal to assist separation of the ridge seal.

The term in its integral state is used herein with respect to the tent side wall to denote that the tent side wall remains as a unit and has not been torn or otherwise separated into component parts as with the design of U.S. Pat. No. 5,067,613.

The invention also provides a blank for use in the construction of a boxed end openable container of the invention, which blank comprises a series of connected panels adapted to be folded and secured to one another so as to form the container, two of said panels being adapted to form the tent side walls of the assembled container, characterised in that at least one of said two panels is provided with fold lines which are adapted to assist bowing of the ridge seal of the assembled and sealed container and of the tent side wall which carries them. Preferably, at least one of said two panels is also provided with a pull tab member adapted to be located on the tent side wall and/or on or adjacent the linear ridge seal of the sealed assembled container and axially substantially in register with that portion of the ridge seal located between or adjacent to the apexes of the V folds in the gable ends of the sealed assembled container whereby application of tension to the pull tab applies a transverse separation force to the ridge seal of the sealed assembled container at or adjacent that portion of the ridge seal located intermediate the apexes of the said V folds.

The pull tab in the present invention can take a wide range of forms and provides a means by which the ridge seal can be separated transversely, preferably by the tent side wall being pulled outwardly from the ridge seal to separate the seal at the portion of the seal between the apexes of the V folds by a peeling separation. Typically, the pull tab is a plastic or card generally planar member having one end, its foot or distal end, secured by adhesive, riveting, heat welding or any other suitable means to the exterior of the side wall of the ridge seal and/or the tent side wall portion of the container. The pull tab can extend over part of the tent side wall and onto the side wall of the ridge seal or can extend over only one of the tent side wall or the side wall of the ridge seal.

Where the pull tab is secured by a riveting technique, it may be preferred to the pull tab with an enlarged mushroom or button distal end. The free, proximal, end of the pull tab is passed through a hole or slot in that part of the upper portion of the tent side wall which is to be incorporated into or be adjacent to the ridge seal and the button or mushroom end drawn up against the material of that wall. The button or mushroom head and the shank of the pull tab can then be heat or ultrasonically welded in position and thus secure the pull tab in position and also seal the hole through which the shank of the pull tab passes. However, it is preferred to form the pull tab as a generally planar member from a sheet of suitable material which is affixed to the exterior of the wall or ridge seal so that no aperture through the wall material is required.

It is particularly preferred to form the pull tab from a sheet material or a composite material having one face thereof formed from a thermoplastic material, eg. a PVC or a polyalkylene, which can be fused to the plastic coating usually applied to the exterior face of the material from which the container is made. Preferably, the composite material is a laminate of a food grade polyethylene upon a polyester. The pull tab can be formed by a suitable die stamping, roller cutting, air blade or other cutting technique from the sheet material.

The pull tab may take a wide range of forms, but typically has a proximal end which is grasped by a user. The proximal end can be formed with transverse ridges to provide a grip surface or can be formed with a finger hole through which the user inserts his finger tip. The proximal end is connected to a shank member, which is typically a continuation of the shape of the proximal end but may be of any suitable form, shape and length. The distal end of the shank member is secured to the tent side wall and/or ridge seal of the container.

It is preferred to form the shank of the pull tab with sufficient length to allow the user to grip the free end of the pull tab and to apply tension to the pull tab by a rolling action using the knuckles of his hand resting against the lower portion of the tent side wall of the container as the fulcrum. This enables the user to open the container using a simple single handed action.

It is also preferred that the distal end of the pull tab is provided with transverse extensions or feet which increase the area of contact between the distal end of the pull tab and the container wall. For example, a foot may extend laterally to each side of the shank of the pull tab for the length of the ridge seal and be secured along the length of the ridge seal by adhesive or by application of heat and pressure, for example during the same heat sealing process used to form the ridge seal. If desired, the upper edge of the distal end of the pull tab, when in position upon the container, can have a triangular shape so that the apex of the triangle is in register with that portion of the ridge seal between the apexes of the V folds and serves to localise the initial transverse force applied by the pull tab at this portion of the seal.

Accordingly, from a further aspect, the present invention provides a boxed end openable container having means whereby a separating force can be applied transversely to the line of the ridge seal of the sealed container at that portion of the linear ridge seal located intermediate or adjacent the apexes of the V folds of the gabled end of the sealed container so as to cause the ridge seal to separate progressively, characterised in that the separation means comprises:

a. a shank member having one or more foot members extending laterally of the distal end of the shank, the foot member(s) being secured to an external face of the ridge seal and/or an adjacent tent side wall; and b. a proximal end to said shank member having means by which a user may grasp the shank member and apply tension thereto.

The foot member(s) can be of any suitable shape and size and can extend over both part of the tent side wall and the side wall of the ridge seal of the sealed container. Preferably, the foot member(s) have extensions which extend beyond the periphery of the face to which the associated foot member is secured and extend into the interface between members of the ridge structure so as to provide a point of weakness in the ridge seal. It is particularly preferred that the foot extends laterally beyond the length of the ridge seal so that the ends of the foot extend around the lateral corner at the edge of the tent side wall and into the V fold of the linear ridge seal, for example for quarter to half the transverse length of the V fold. We have found that, by extending the foot of the pull tab into the interface between the opposing surfaces of the dry walls of the V fold, application of tension to the pull tab applies not only a separating force transversely to the ridge seal in the region of the apexes of the V folds, but also causes the application of a compressive force along the line of the ridge seal and a separating force to the seal between the opposing surfaces of the dry walls of the V fold in the gabled ends of the container assisting bowing of the tent side wall and separation of the ridge seal. Furthermore, by extending the foot of the pull tab into the V fold the risk of premature separation of the foot from the face of the tent side wall and/or the side wall of the ridge is minimised. Separation of the extension of the foot from the material of the V fold requires a shear force rather than a peel force, as is the case with that portion of the foot secured to the face of the tent side wall. If desired, the exposed face of the foot of the pull tab located between the opposing faces of the dry walls in the V folds can be coated with or rendered abhesive to reduce adhesion between the exposed face of the pull tab and the wall material and to introduce a zone of weakness into the ridge seal between the dry walls of the container in the V folds.

As indicated above, the foot members preferably extend laterally from, and preferably substantially symmetrically from, each side of the distal end of the shank member and the extensions are lateral continuations of the foot members. However, where the foot members are attached to a tent side wall axially adjacent the foot of the ridge wall, notably with the upper edge of the foot member lying immediately adjacent to or along the fold line where the tent side wall is folded to form the outer side wall of the ridge structure, it is preferred to provide at least part of the extension as an axially upward extension, whereby the extension extends upwardly into the ridge seal itself and thus provides an area of weakness in the ridge seal. This upward extension can have an abhesive applied thereto to enhance the weakening effect on the ridge seal caused by the extension. However, it is preferred that such an extension does not extend for the full height of the ridge seal, for example for from 25 to 75% of that height, so that a seal can be formed between the opposing faces of the ridge material at the upper edge of the ridge.

We believe that such forms of pull tab are novel and the invention further provides a generally planar pull tab adapted to be applied to a boxed end openable container, which pull tab comprises:

a. a shank member extending between a proximal end adapted to be grasped by a user and distal end adapted to be secured to a tent side wall and/or a side wall of the ridge seal of the sealed container or a blank for use in the manufacture of such a container;

b. one or more foot members extending transversely and substantially symmetrically from said distal end of said shank member;

said pull tab being made from a sheet material having a surface which can be fused with or otherwise adhered to the material of said container wall or ridge. Preferably, said foot is provided with an axial extension thereto and the pull tab is made from a laminate of a polyalkylene on a polyester.

The invention also provides a container having a pull tab of the invention secured to a tent side wall and/or the side wall of the ridge seal at or adjacent the foot of the ridge seal and substantially axially in register with that portion of the ridge seal located intermediate or adjacent to the opposed apexes of the V folds in the gabled end of the assembled and sealed container. The invention also provides a blank for use in the manufacture of such a container having a pull tab as just defined attached to the blank.

The heat seal or other anchorage between the tent side wall and/or the ridge side wall and the material of the foot of the pull tab will usually be sufficient to ensure that the foot of the pull tab does not separate from the container wall or seal, notably where the pull tab is made from a polyethylene/polyester laminate. However, it may be desired to locate the transversely extending foot of the pull tab in register with the ridge seal and to fold over a portion of the tent side wall which extends axially beyond what is to be the upper edge of the ridge seal so as to form a channel within which the foot is located. The folded over extension of the tent side wall is then secured to the material forming the ridge seal by a heat seal or other means to form a sleeve within which the foot of the pull tab is trapped. In a particularly preferred embodiment, the foot of the pull tab has a smaller plan size than the ridge seal against which it is to be secured and the folded over portion of the tent side wall is secured in position to trap the foot of the pull tab by the same heat sealing operation as is required to form the ridge seal. Where the foot extends into the V fold of the ridge seal, it is preferred that that portion of the foot have an axial dimension which is from 50 to 75% of the axial depth of the ridge seal at that area and that the foot does not extend into the top 15 to 25% of the ridge seal so as to enable a ridge seal along the top of the foot to be achieved.

It will be appreciated that the foot of the pull tab may be located wholly within the region of the side wall of the ridge seal and not exclusively or additionally upon the exposed face of the tent side wall. It is usually preferred to cause at least part of the shank of the pull tab to be secured to the exposed tent side wall so as to assist initial bowing of the tent side wall adjacent the foot of the ridge seal, which assists separation of the ridge seal.

If desired, the free end of the pull tab in all embodiments of the invention can be folded and/or tack welded or otherwise secured to tent side wall so that it lies against the face of the wall and does not project, thus minimising the risk of contamination and/or accidental snagging and operation of the pull tab during handling, but can be readily released by a user to spring away from the wall of the container to assist gripping of the free end of the pull tab by a user.

As indicated above, bowing of the ridge seal assists separation of the ridge seal at that portion intermediate the opposed apexes of the V folds. It is preferred to provide the ridge seal with an axial crease, score or fold line at this point to assist formation of a sharp bend at this point in the ridge seal. Further fold lines, for example creases or score lines, are preferably provided in the tent side wall connecting with this axial fold line to assist bowing of the tent side wall, notably when no pull tab is present and the separation of the ridge seal is achieved by application of a lateral force to the opposed edges of the tent side wall. In a particularly preferred embodiment of the invention, the fold lines in the tent side wall extend from the points at which the lateral edges of the base of the tent side wall connect to the side wall of the main body of the container to the foot of the fold line in the ridge seal or an axially downward extension of that fold line. Alternatively, these fold lines can extend to the apex of the ridge seal to form a triangle of tent side wall and ridge material bounded within the fold lines and the base of the tent side wall.

Where a pull tab is provided, it is preferred also to provide such fold lines in the ridge seal and to the tent side wall and to affix the pull tab or part of the shank of the pull tab to the tent side wall at the point of intersection of the axial fold line and the fold lines extending from the basal corners of the tent side wall or to the triangular area of the tent side wall and side wall of the ridge seal contained between those fold lines and the base of the tent side wall. It may also be preferred to provide secondary fold lines which extend from the point of anchorage of the pull tab to the lateral extremes of the ridge seal so as to assist outward bowing of the tent side wall to assist outward deployment of the tent side wall to form the spout outlet as the ridge seal separates.

In addition to the pull tab(s) and fold lines described above, the container of the invention may incorporate other features to enhance its utility. Thus, it may be desired to provide means by which the ridge seal can be at least partially reformed so that a partially emptied container can be re-sealed for storage after use. In a particularly preferred embodiment, the free, proximal, end of the pull tab is formed as a transversely enlarged head having the finger hole formed in the head. The material of the upper edges of the tent side walls which are to be incorporated into the ridge seal are provided with undercut recesses which are to register with the shank of the pull tab. The recesses are configured so that the shank of the pull tab is a snap fit into them. When the ridge seal has been separated and some of the contents of the container discharged, the open end of the container can be closed by reforming the ridge, with the undercut slots in register with one another. The free end of pull tab is carried over the line of the re-formed ridge so that the head lies on the opposite side of the ridge to the point of attachment of the foot of the pull tab. The shank of the pull tab is snapped into the undercut recesses. The enlarged head of the pull tab bears against the side of the ridge and retains the ridge in its closed, reformed, position. Whilst such a re-formed ridge seal does not provide a fluid tight seal, it is adequate to minimise spillage during normal handling of the container until it is desired to re-open the container and discharge further contents.

In addition, the other tent side wall to that carrying the pull tab can be provided with an axially extending portion which can be folded over to form a double thickness of material in the ridge. This imparts greater rigidity to the ridge in the sealed and unsealed configurations. If desired, this axial extension can, when folded over, extend back over the top portion of the remainder of that tent side wall below the foot of the ridge seal to impart further rigidity to the ridge structure and reduce flexing of that side of the ridge seal when tension is applied to the pull tab. This extension to the tent side wall can carry lateral tabs which can be secured to the side wall of the container and serve to retain the gabled end of the container in a flattened configuration to present a more truly boxed end to the top of the container.

The fold lines in the ridge seal and/or in the tent side wall are conveniently formed by scoring or part cutting through the material of the blank from which the container is formed using conventional scoring or cutting techniques used in the container producing industry during the formation of the other fold lines normally formed on the container blank to assist folding of the various panels of the blank during assembly of the container.

The pull tab can be formed in or secured to the planar face of the tent side wall and/or side of the ridge at any suitable point during the formation of the blank from which the container is to be assembled. Alternatively, the pull tab can be secured to the partially assembled container formed by forming the blank into a tube upon a mandrel or other support. The pull tab may also be secured to the container after it has been fully assembled or filled as part of or subsequent to the closure process in which the ridge seal is formed. However, it will usually be preferred to apply the pull tab to the plastic, card or plastic coated card blank from which the carton is subsequently assembled. Such a blank can be of conventional form, but will preferably carry additional fold or crease lines as described above already formed in it to assist bowing of the ridge seal and tent side wall at the desired positions. It may also be desired to indent the container wall material at the location at which the pull tab is to be applied so that the pull tab is recessed into the wall material, for example by passing the blank through the nip of a pair of rollers or by applying sufficient pressure during the heat sealing attachment of the pull tab to the blank to cause partial crushing of the underlying material of the blank. This may avoid excessive thickness of the combination of the pull tab and container wall at this location which might affect the feeding of the tabbed blank through conventional container assembly machinery.

The pull tab can be made by any suitable technique, for example by cutting a suitable shape from a sheet material using a die, roller, air blade or other cutter. The material is preferably one which can be fused to the underlying material of the container. However, it is within the scope of the present invention for the pull tab to be secured by adhesive, in which case the material from which the pull tab is cut can carry adhesive on that face to be applied to the container material. This adhesive is preferably a pressure sensitive or contact adhesive, for example a PVA type of adhesive, and may be protected by a siliconised paper layer until the pull tab is applied. As indicated above, the other face of the pull tab may carry abhesive, for example a silicone, on selected areas and this can be applied by any suitable technique. Where the pull tab is to be applied using label application techniques and equipment, it may be preferred to form the pull tab from a continuous ribbon of a suitable material, eg. of the composite polyethylene/polyester, in which the pull tab outline is not fully cut from the ribbon so as to form a continuous length of material from which the individual pull tabs can be separated at the time of application to the container material. Such partial separation can be by way of incomplete cutting of the profile of the pull tab so as to leave uncut segments, or the cutter can be set so as not to cut through the siliconised paper or other backing so that the individual pull tabs are cut but remain on the backing for transport to the application station.

The pull tab can be applied by any suitable technique. Since the pull tab will usually be in the form of a thin planar member, it readily lends itself to application using label application machinery.

The blank cutting, folding and scoring processes are typically carried out at high linear speeds of travel of the card or other wall material, and this may impose excessive requirements on the label application process. However, container blanks are usually stored for a period after manufacture and prior to assembly of the container. The pull tabs can be applied at a slower rate of travel of the wall material blanks during this storage period. If desired, blanks can be fed to several label application machines operating in parallel to achieve the necessary tabbed blank production rate.

As stated above, the pull tab may be secured to the container by adhesive, notably where the pull tab is applied by a label application machine. However, it is particularly preferred to secure the pull tab in position by a heat sealing technique in which the thermoplastic surfaces of the container wall material and of the pull tab are fused together. In this case it may be desired to apply the pull tabs individually from a suitable magazine rather than from a moving continuous web, and to secure the pull tab in position by a spot of adhesive prior to the application of the hot die heat sealer.

To open a sealed container carrying a pull tab of the invention, the user grips the free end of the pull tab, rolls his hand downwardly until his knuckle engages the tent side wall of the container and then rolls his hand about the knuckle contact to apply a transverse separation force to the ridge seal to open the container. As the container is opened by separation of the ridge seal, the tent side wall upon which the pull tab acts bows laterally outward and provides a spout type outlet to the container as wall as transmitting the separating force applied by the pull tab progressively along the length of the ridge seal, thus enabling the whole length of the seal to be separated. Where the foot of the pull tab extends into the V fold of the ridge seal, this applies a lateral force parallel to the line of the ridge seal, thus further aiding initial bowing of the ridge seal and the tent side wall and separation of the ridge seal.

The surfaces of the spout which are contacted by the discharging contents of the container are those of the wet walls which have been bonded together during sealing of the container and have not been exposed to external contamination during storage and transport prior to opening of the container. Furthermore, since at least part of the pull tab is usually connected to the tent side wall immediately below the line of the ridge seal, the force applied to the pull tab will usually initially cause separation of the ridge seal from its base within the container, thus further reducing the risk of contamination as the ridge seal is separated. The containers of the invention can therefore be manufactured and filled under sterile or clean conditions so that, when the container is opened and discharged, the contents are not subjected to contamination from contact with the newly exposed surfaces of the spout. The container can therefore be used for the packaging of foodstuffs and other materials which require to be held under sterile conditions and which must be subjected to the minimum of contamination during discharge from the container.

The invention thus provides a simple and effective solution to the problem of opening a boxed end openable container without the need to modify the container manufacturing or filling process significantly, thus enabling the invention to be applied to conventional equipment. Alternatively, the pull tab can be applied to an assembled or sealed container using any suitable machine located at the end of the container assembly, sealing or filling line.

DESCRIPTION OF THE DRAWINGS

To aid understanding of the invention, a preferred form thereof will now be described by way of illustration and with respect to the accompanying drawings, in which.

DESCRIPTION OF THE PREFERRED EMBODIMENT

The container comprises a generally rectangular or square main body portion 1, whose bottom has been closed by conventional box folds or other means, and which contains milk, fruit juice or other fluid or a fluent powder. The container is made from a wax or plastic coated paper or card so that it can readily be folded along score lines or the like formed in a sheet blank from which the container is made and the folded configuration secured in place by heat sealing or otherwise adhering the overlapping edge portions of the assembled container. Alternatively, the container can be made by blow or extrusion moulding from a suitable plastic so that the container is formed as a unitary article with an open top.

Where the container is made from a flat blank, this is folded and secured in its desired erected form by heat welding, adhesive or other securing techniques. For convenience, the invention will be described hereinafter in terms of the use of a polyethylene or other thermoplastic polymer coated card as is conventionally used in the manufacture of such containers.

The upper portions of the side walls of the container have been folded in upon one another to form a conventional boxed end. In such an operation a V fold 2 is formed in each of two opposed side walls with the apex of each V directed towards the centre line of the container. This has the effect of bringing the top edges of the other two side walls together to form a tented end to the container. The top edges of the side walls lie against one another to form a ridge 3 lying along a transverse line extending along the line of indentation of the V folds 2. The edges are sealed together by applying heat and pressure using a conventional heat sealing bar or the like to form a comparatively deep transverse seal closure along the ridge 3. The depth of the seal is sufficient to incorporate the upper edges of the V folded walls to ensure a fluid tight closure. If desired, the edge material forming the ridge can be folded over upon itself to form a convoluted seal to the end of the container.

Figure 1:
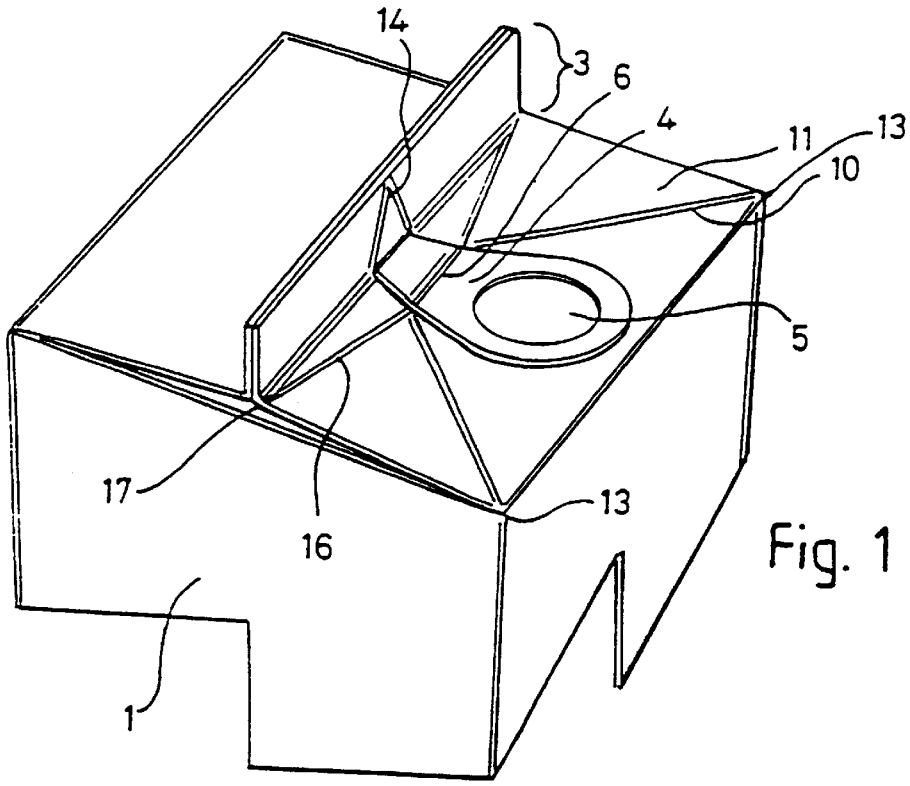
FIG. 1 is a perspective view of the boxed end openable container in the fully closed configuration carrying a pull tab.

As shown in FIG. 1, the tented end to the sealed container can be collapsed to form a flat boxed end to the container.

A pull tab 4 is secured by a heat seal or suitable adhesive to the tent side wall material which is to form part of the exposed end of the container. Preferably, the pull tab 4 is cut from a sheet of a polyethylene/polyester laminate and is secured to the tent side wall by fusing of the opposed polyethylene faces using a conventional heat sealer. The free end of pull tab 4 can have a finger hole 5, transverse ribs or other grip assisting means formed therein to aid gripping of the pull tab by a user. Typically, the pull tab is formed with a transverse fold line or score 6 so that the pull tab can be flexed upwards as the user's finger is inserted into the finger hole 5. If desired, the free end of the pull tab 4 can be secured in position against the tent side wall of the container by a tack seal or other separable means so that the pull tab is not accidentally pulled during handling of the container.

Figure 2:
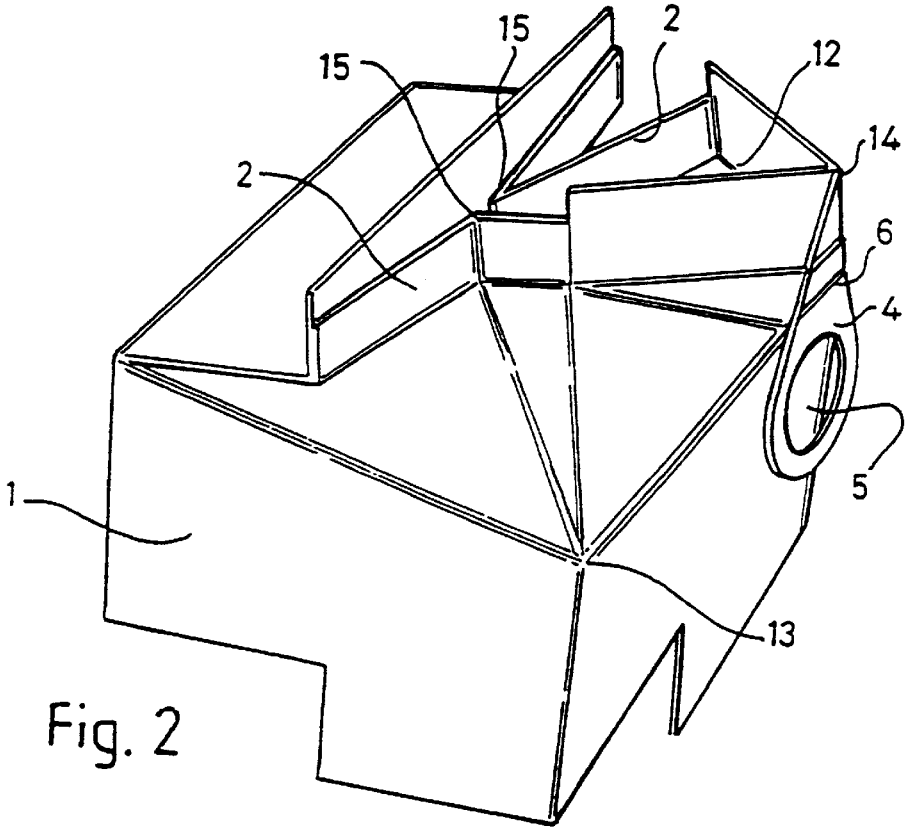
FIG. 2 shows the container of FIG. 1 with the ridge seal partially opened.

It is preferred to provide fold lines 10 in the tent side wall 11 to which the pull tab 4 is affixed. These fold lines 10 assist bowing of the tent side wall 11 as the ridge seal 3 separates and the outward deployment of the centre portion of the upper edge of wall 11 to form the outlet spout 12 shown in FIG. 2. These fold lines 10 run from the lower outer corners 13 of wall 10 to the ridge seal 3 at a point 14 intermediate the apexes 15 of the V folds in the ridge seal. Where the fold line runs axially across the ridge seal 3 to point 14, this will also aid the formation of a sharp bend when the ridge is bowed and this also aids separation of the ridge seal at this point. The pull tab 4 is affixed to wall 11 within the triangle formed by the fold lines 10, preferably at a point immediately below the ridge seal 3. It is further preferred to provide secondary fold lines 16 which extend from the point of affixing of pull tab 4 to wall 11 to the laterally outward extremes 17 of the ridge seal 3.

In use, the user inserts his crooked finger upwardly through finger hole 5 in pull tab 4 and rests his knuckle against the lower portion of wall 11. He then rolls his crooked finger about the knuckle to apply a lateral pull to pull tab 4. This applies a shear force on the ridge seal 3 at point 14 which causes the seal to separate. This allows wall 11 to bow outwardly. The fold lines 10 and 16 cause the wall 11 to adopt a spout configuration as the folds forming the gable end structure underlying wall 11 also unfold.

Surprisingly, we have found that if the user first bends the ends of the linear ridge seal backwards, ie. in the opposite direction to which the lateral force is to be applied by the pull tab 4, the tent wall 11 initially bows upward. This aids progressive separation of the ridge seal and the formation of a spout type outlet to the container when a force is applied to the pull tab.

Figure 3:
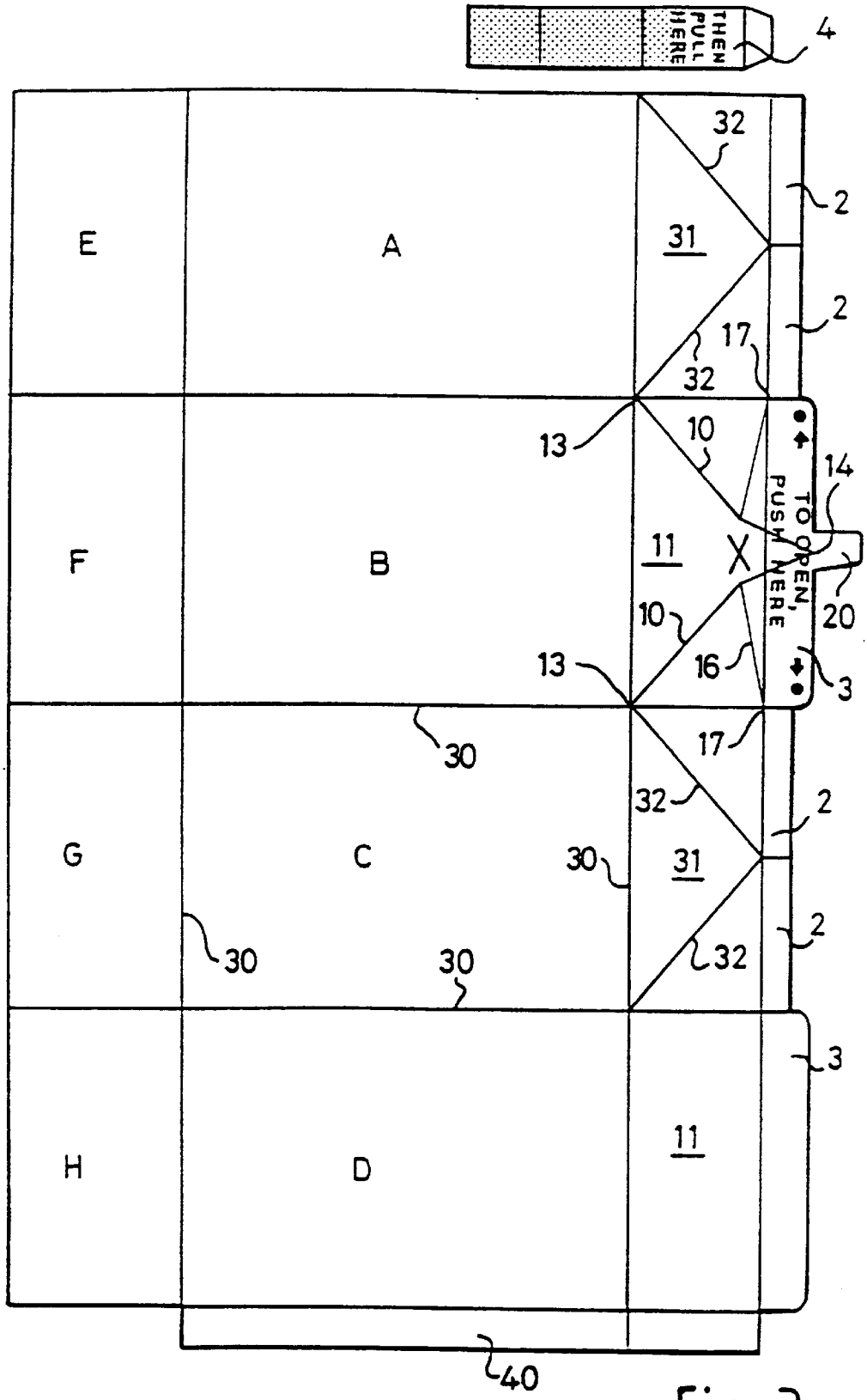
FIG. 3 shows a plan view of a blank for use in the construction of the container of FIG. 1 and an alternative version having the pull tab as an extension of a tent side wall.

The container is made from a blank of the type shown in FIG. 3, which comprises a series of panels A, B, C and D defined by fold lines 30 in a sheet of plastic coated card. These panels are to form the side walls of the container 1. The side panels are also linked to end panels E, F, G and H which are to form the base to the container. The panels A, B, C and D are also linked to the panels which are to form the top of the container. Two of the top panels 31 carry fold lines 32 which extend from the outer basal corners of the panels to the base of the strip of material which is to form the V folds 2 of the container of FIG. 1 within the ridge 3 of the assembled container. The panels 31 are to be folded to form the gabled end structures of the assembled container.

The other two top panels are to form the tent side walls 11 of the assembled container of FIG. 1 and carry the fold lines 10 and 16 and the material to form the ridge 3 of the assembled container. FIG. 3 also shows a separate pull tab 4 which is to be affixed to wall 11 at point X between fold lines 10. Alternatively, where possible contamination of the contents of the container can be tolerated, the pull tab can take the form of an axial extension 20 from panel 11 as shown.

The container is assembled by folding the panels about the fold lines in the normal manner and securing panel A to side tab 40 and the base panels to one another by heat welding or other techniques. The panels 31 are folded inwards to form the V folds 2 and so bring the upper edges of walls 11 into contact to form the ridge 3 which is sealed in the conventional manner after the container has been charged with the appropriate contents.

Figure 4:
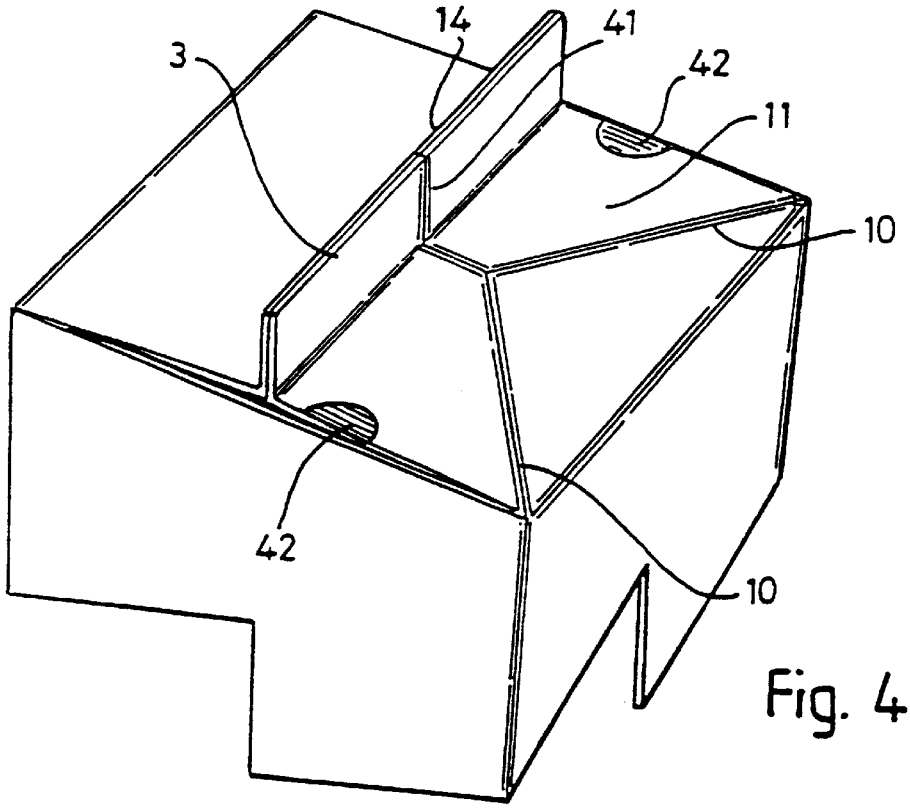
FIGS. 4 and 5 show an alternative form of the container of FIG. 1 not using a pull tab in the closed and partially open forms.
Figure 5:
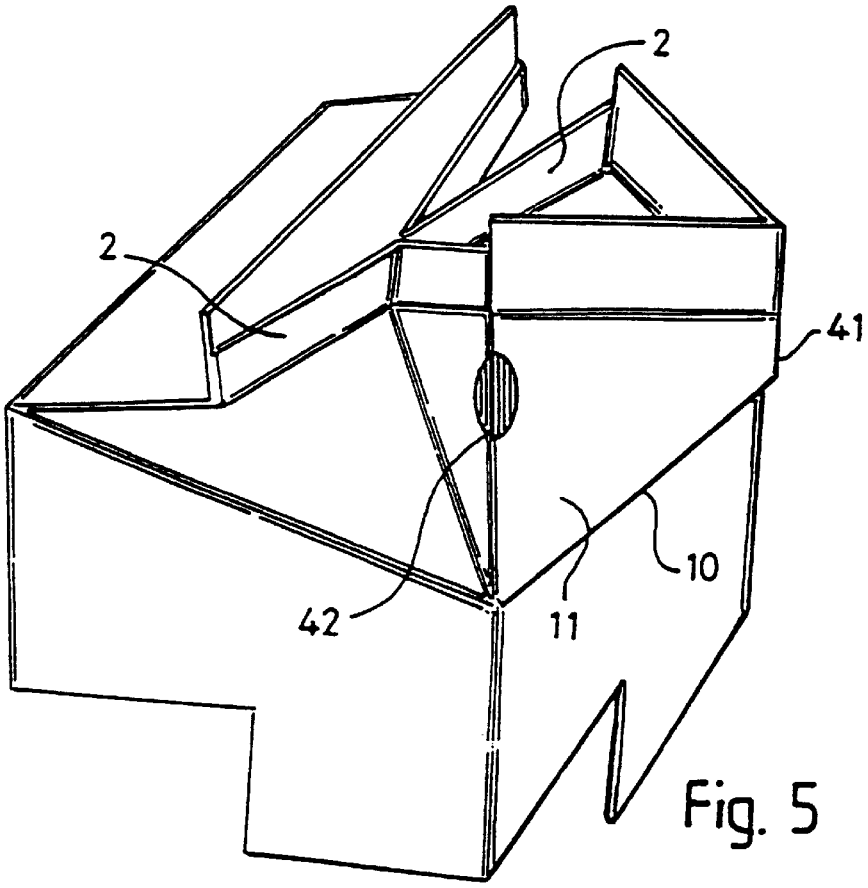

In the alternative form of the container shown in FIGS. 4 and 5, the pull tab 4 has been omitted and the fold lines 10 in wall 11 converge to a point adjacent the foot of the ridge 3 and then extend as a single fold line 41 to point 14 on the ridge seal 3. Two finger plates 42, for example in the form of metal discs folded over at their diameter and crimped onto the edge of wall 11, can be secured to opposite edges of wall 11. In use, the user first bows the linear ridge seal by bending the ends of the ridge 3 backwards. This causes the middle of the ridge to bow forwards and causes the fold lines 10 and 41 to rise. Application of pressure to the finger plates 42 directed towards the centre line of wall 11 compresses wall 11 laterally and applies shear to ridge seal 3, causing the ridge seal to separate and allowing the top edge of wall 11 to bow away from the ridge line to form an opening to the container. Progressive lateral compression of wall 11 causes the formation of the spout type outlet to the container to form as shown in FIG. 5.

Figure 6:
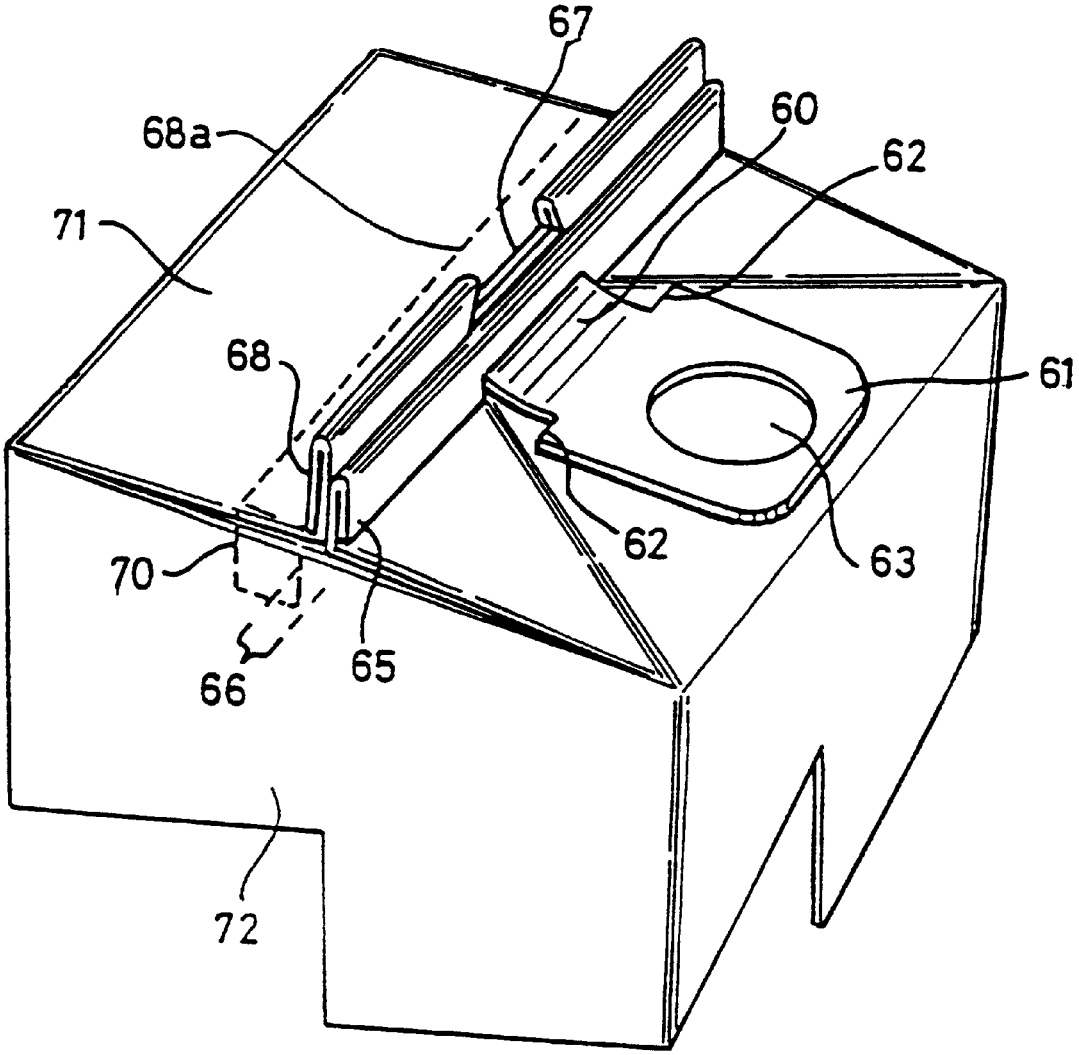
FIGS. 6 to 10 show alternative forms of the container of FIG. 1 and pull tabs and blanks for use in the construction of those containers.
Figure 7:
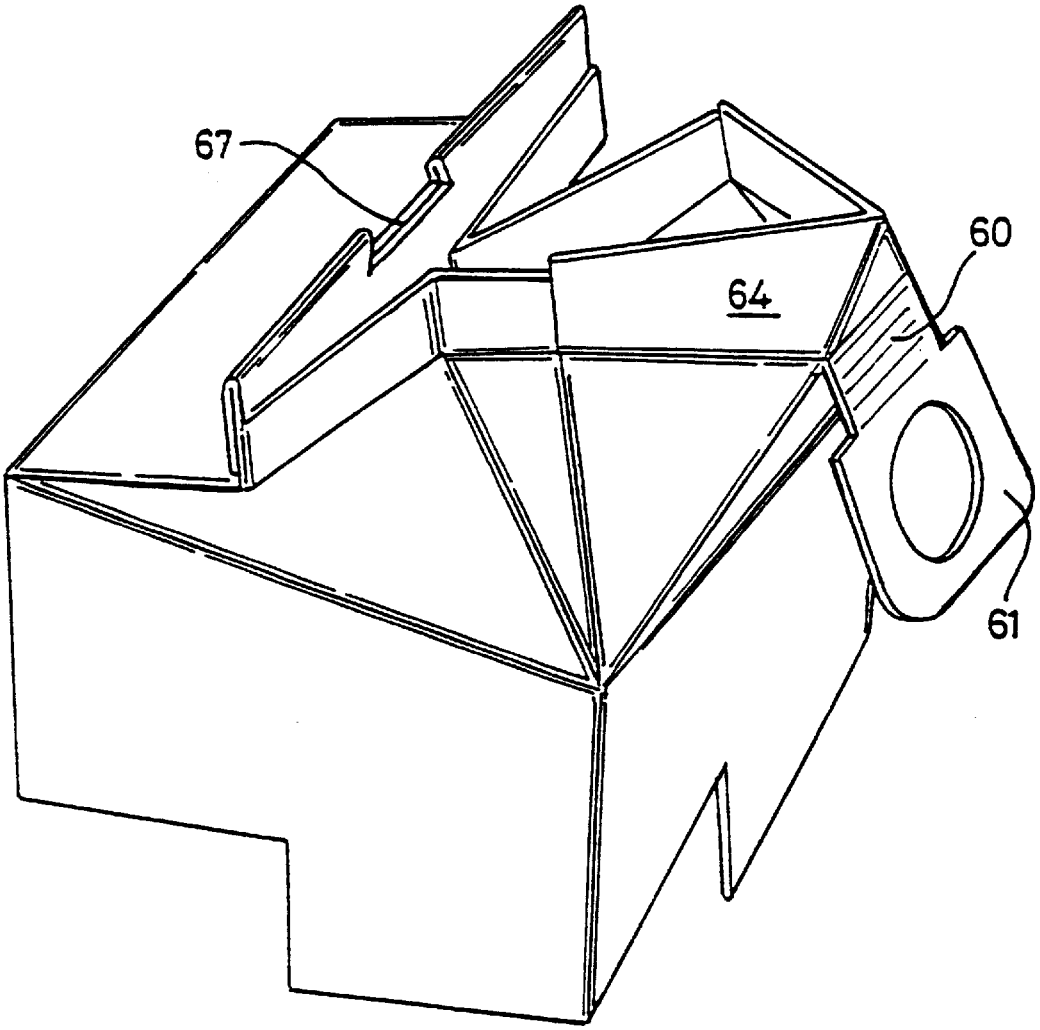
Figure 8:
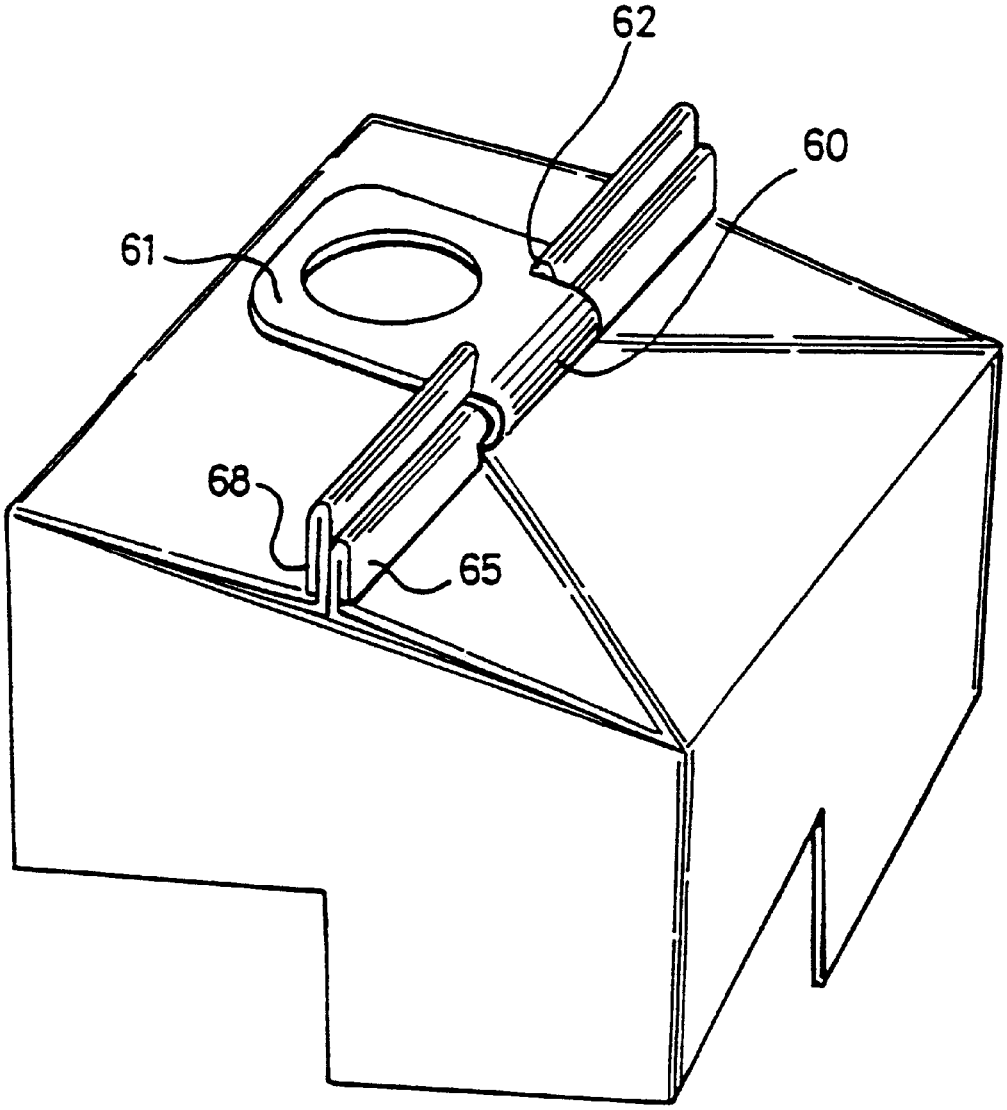
Figure 9:
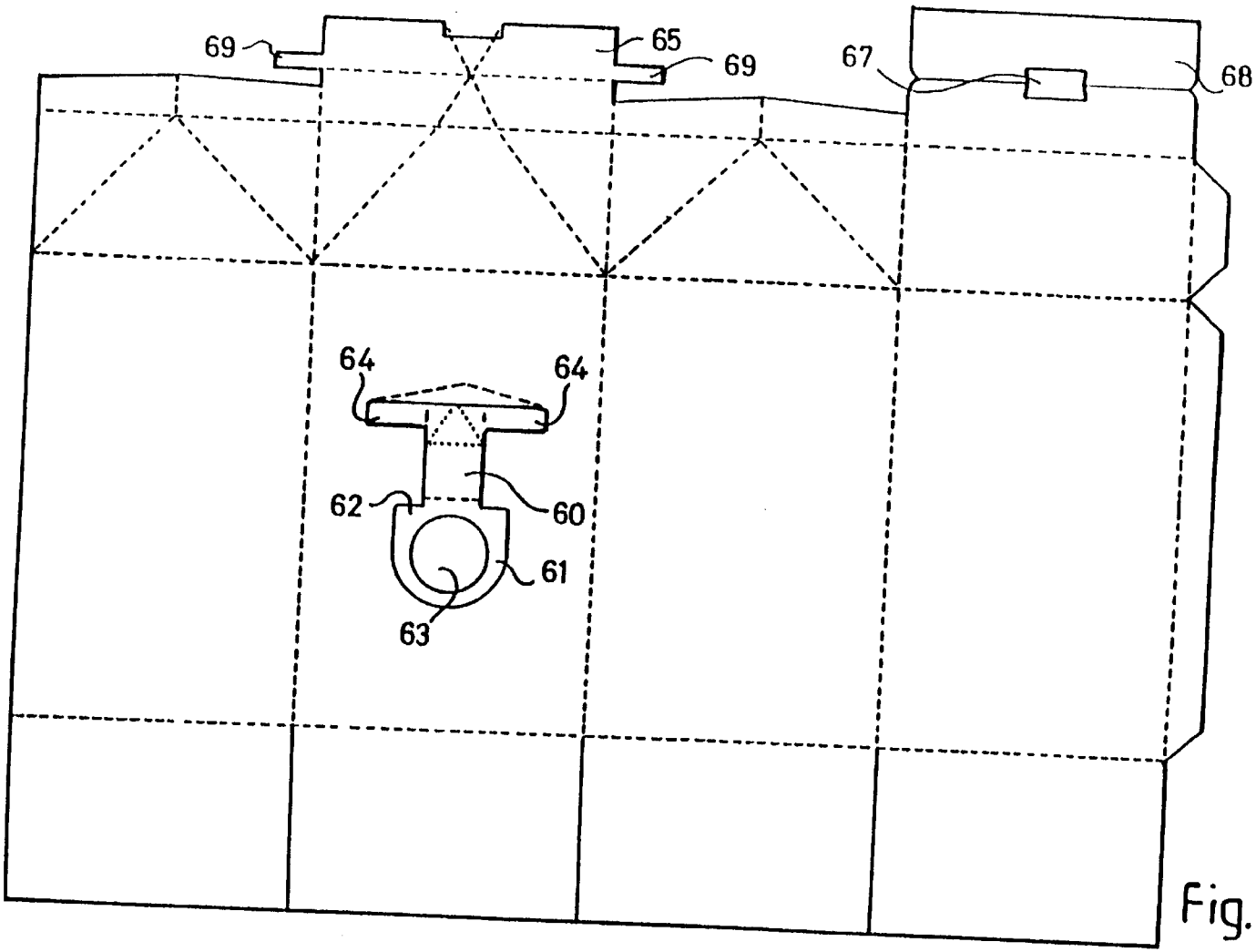

In the yet further alternative form of the container shown in FIGS. 6 to 9, the shank 60 of the pull tab is provided with an enlarged head 61 having square cut shoulders 62 where it is connected to shank 60. Head 61 is provided with a finger hole 63. As shown in FIG. 9, shank 60 is provided at its other end with two laterally extending feet 64. The feet can be of rectangular shape as shown or can be triangular as shown dotted in FIG. 9. The feet 64 are configured so that they lie within the plan area of the side wall of the ridge seal. It is preferred to form the upper axial extremity of one tent side wall with a fold over portion 65 which forms a channel 66 into which the feet 64 are located when the ridge seal is formed as shown in FIG. 6. The other tent side wall is preferably formed with an undercut recess 67 at its upper edge into which the shank 60 is a snap fit.

When the container is filled, the ridge is heat sealed closed and the folded over portion 65 of the tent wall traps the feet 64 of the shank 60 in position as shown in FIG. 6. When the head 61 is pulled, it applies a shear force to the ridge seal and the seal separates to form a spouted opening as shown in FIG. 7. Since the load of the force applied to head 61 is spread over a wide area and the feet 64 are trapped by the folded over portion 65, there is reduced risk of separation of the pull tab from the container.

After the desired amount of the contents of the container have been discharged, the spout opening is collapsed to re-form the ridge. The head 61 of the pull tab is then carried over the ridge and the shank 61 engaged in the undercut recess 67 with the shoulders 62 of head 61 engaging the side face of the reformed ridge to secure the ridge in the re-formed configuration as shown in FIG. 8.

Figure 10:
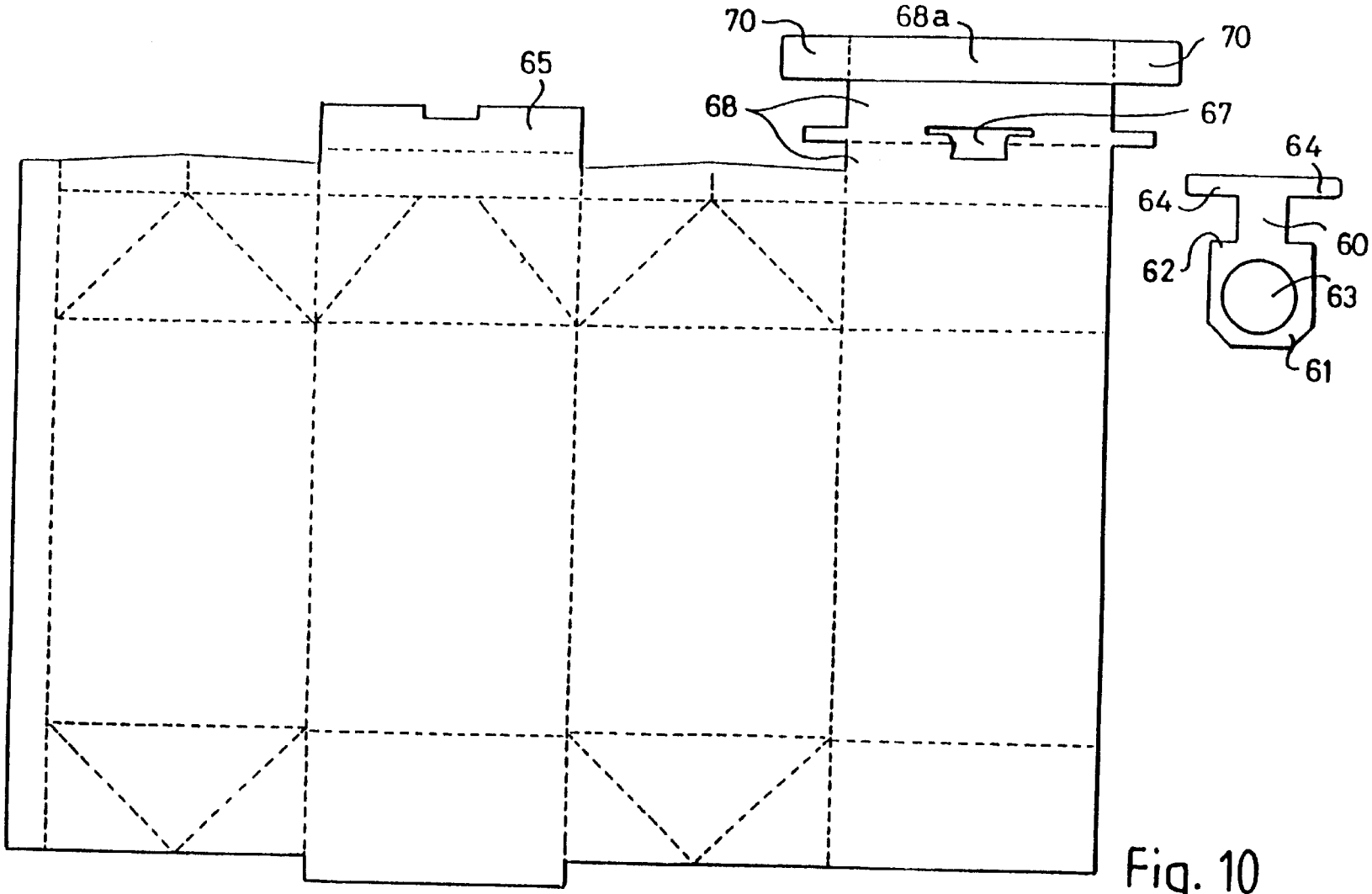

Such a container is simply made from a blank as shown in FIG. 9 in which the tent walls of the container of FIG. 1 are modified to extend axially to provide the fold over portion 65 on one tent wall and a recess 67 on the upper edge of the other tent wall. If desired, this other tent wall can be provided with a fold over portion 68 so that the resultant ridge has two thicknesses of material provided by this tent side wall to impart greater strength and rigidity to the ridge to retain the head 61 of shank 60 in the position shown in FIG. 8. If desired, transverse extensions 69 can be provided to either or both tent side walls at the ends of the ridge material of the blank of FIG. 9. If the sealed ridge is folded to lie flat against the sealed boxed top end of the container, it can be retained in position by passing the extensions 69 under the lip of the gable end and securing the extensions 69 in position by heat sealing or otherwise. In this way the container of FIG. 6 can be presented in a substantially boxed end configuration permitting stacking of the containers upon one another. To enhance the boxed end of the container of FIG. 6, the blank of FIG. 9 can carry tabs 70 as shown in FIG. 10 and the extension 68 can be larger than shown in FIG. 9 so that its distal portion 68*a* extends as shown dotted in FIG. 6 onto the flat area 71 of the tent side wall. The tabs 70 can then be folded downwardly and secured against the side wall 72 of the container to hold the gable end of the container in a substantially flat configuration. The ridge can then be folded to lie flat against the end of the container to permit stacking of the containers upon one another. The distal portion 68*a* also serves to support the ridge in against flexing as tension is applied to the pull tab 60/61, thus aiding separation of the seal as the pull tab is pulled.

Figure 11:
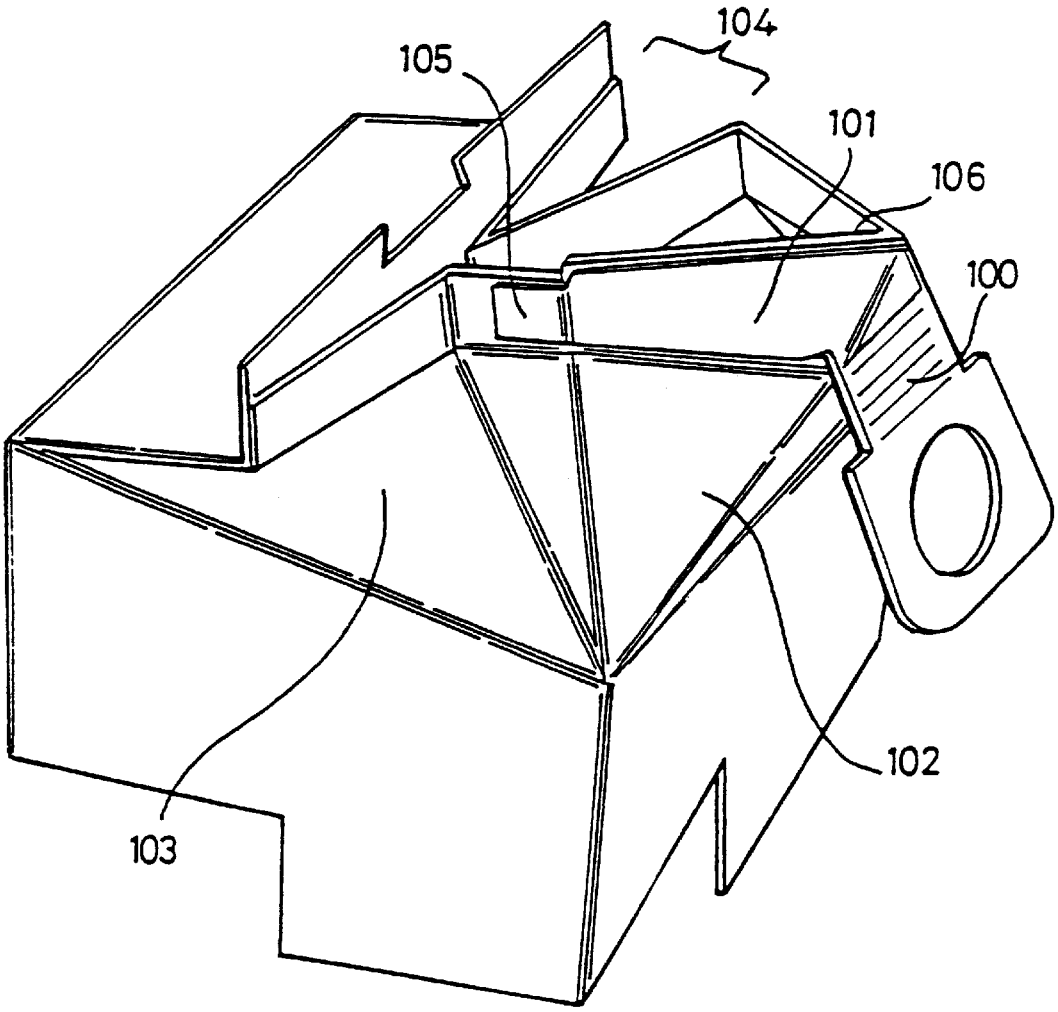
FIGS. 11 and 12 show and alternative form of pull tab having lateral extensions to the foot of the pull tab and its location on a blank.
Figure 12:
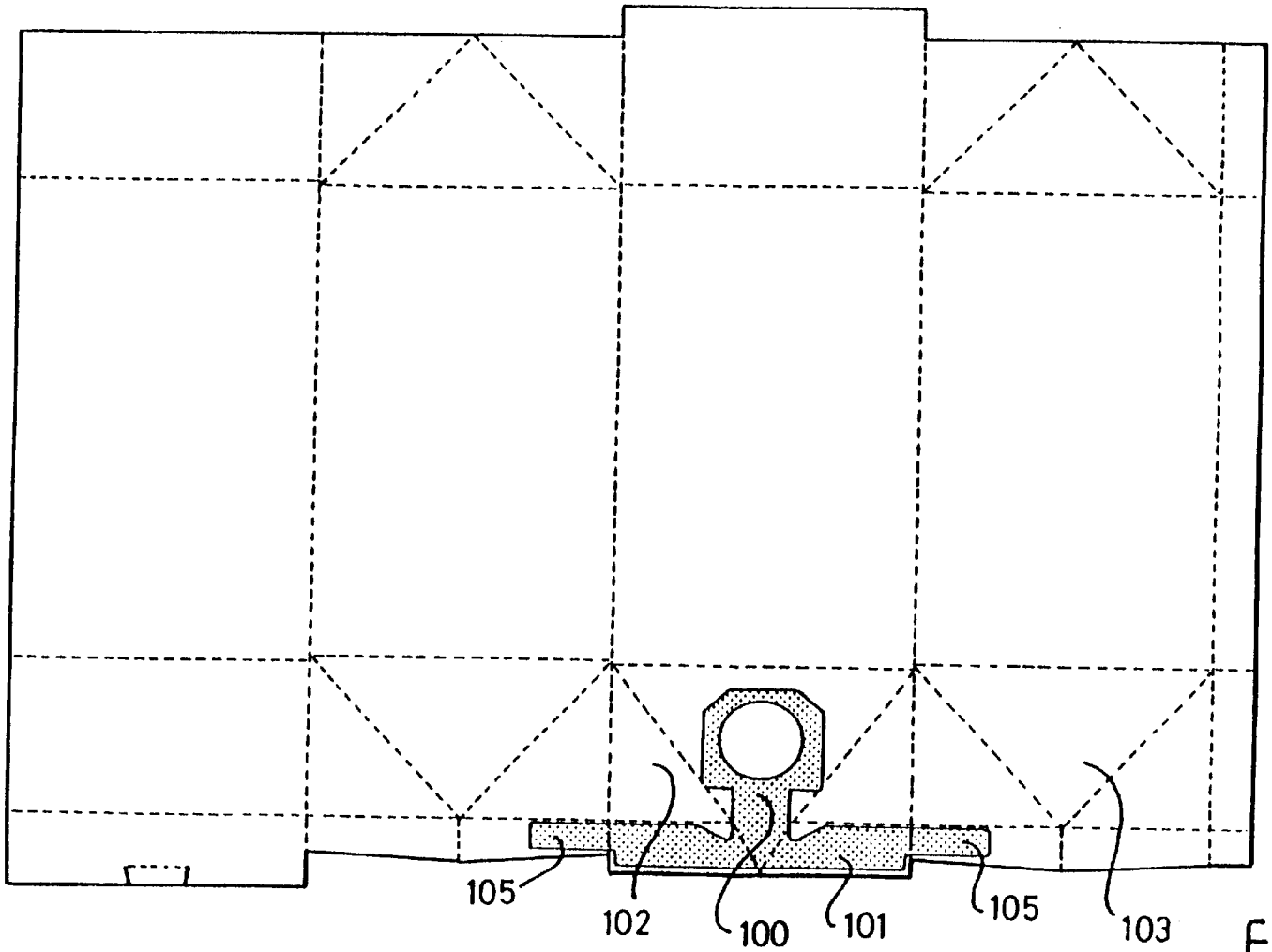

In the form of container shown in FIG. 11, the pull tab 100 has a feet 101 which extend laterally beyond the transverse extent of tent side wall 102. The extending portion of the foot 101 is folded around the edge of wall 102 to extend between the opposed faces of the gable end wall 103 which is folded in a V fold 104 when the ridge construction is formed. The extremities 105 of the foot 101 are thus incorporated into the ridge seal construction. A blank carrying such a pull tab is shown in FIG. 12. When the pull tab is pulled, this applies a force to bow the wall 102 and the portions 105 of the feet 101 extending around the two opposed corners of wall 102 apply a lateral pressure parallel to the line of the ridge seal and a peel force to separate the opposed faces of wall 103 in the V fold of the ridge seal construction assisting separation of the ridge seal and the bowing of wall 102 to form the spout outlet 106.

Figure 13:
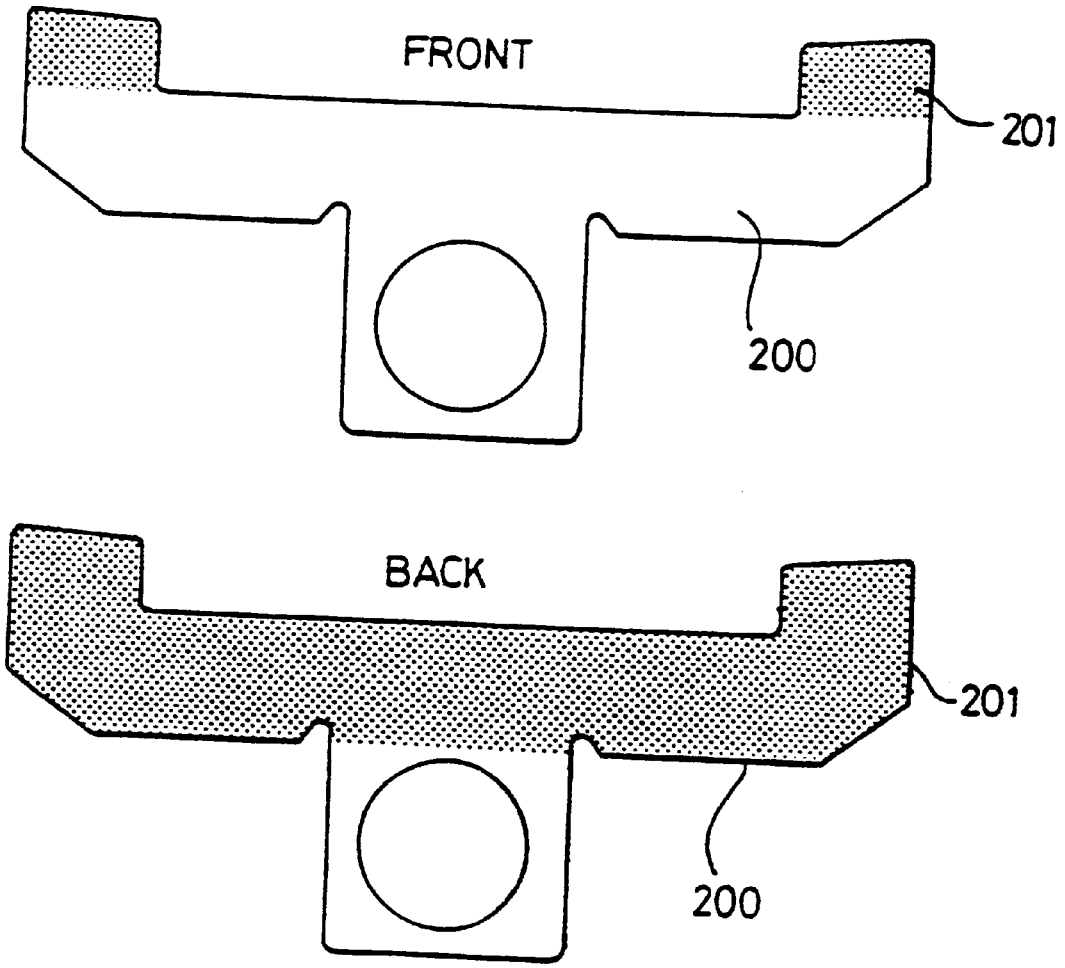
FIGS. 13 and 14 show a further alternative form of pull tab and its mounting on a blank.
Figure 14:
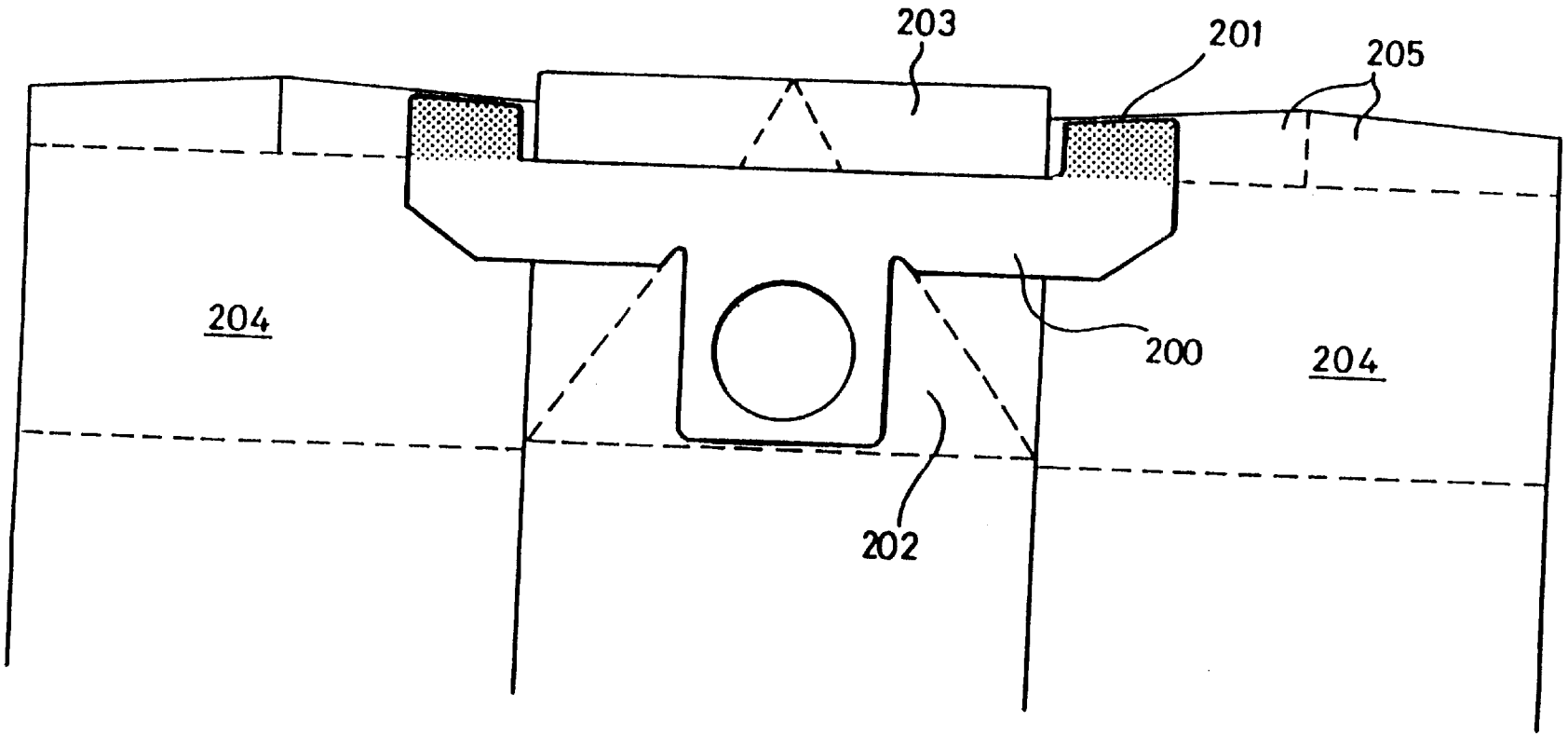

In the alternative form of pull tab shown in FIG. 13, the feet 200 have axial extensions 201 which extend upwardly when the pull tab is in position to lie within the interface between the walls of the gabled end forming the V fold. These extensions impart a zone of weakness to the ridge seal, even when the pull tab is mounted with the lateral portions of the feet 200 mounted on the tent side wall and not within the side wall area of the ridge seal. As shown in FIG. 13, the front face of the pull tab, ie. that which is to be secured to the container wall material, has adhesive applied to it or is the area which is to be heat sealed to the container wall material. The other face of the axial extensions which is to contact the dry wall surfaces in the V fold can have abhesive applied to it to reduce the strength of the ridge seal at this point. FIG. 14 shows the pull tab of FIG. 13 secured to a blank. The pull tab is secured to the tent side wall 202 with the upper edge of feet lying adjacent the foot of the material 203 which is to form part of the ridge seal. The axial extension 201 to feet 200 lie within part of the material 205 which extends axially from the gable end wall 204 and which will form the dry wall surface of the V fold when the container is assembled.

Figure 15:
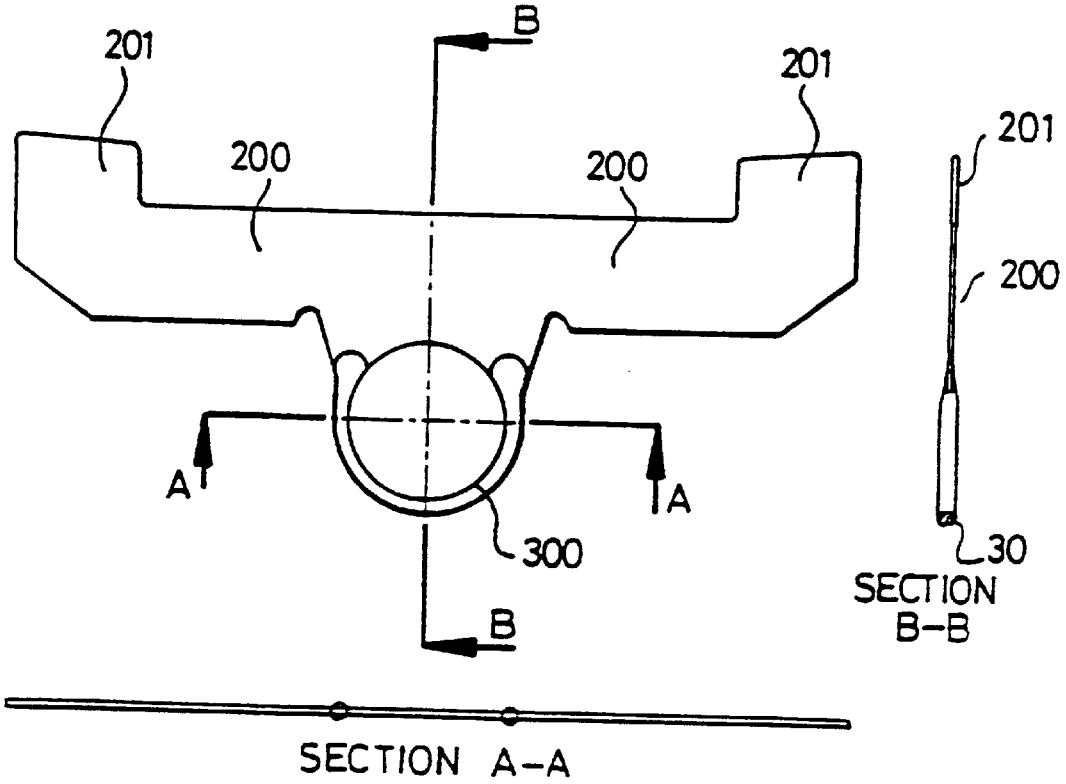
FIGS. 15 and 16 show yet further forms of the pull tab.

As shown in FIG. 15, the pull tab of FIG. 13 can be formed with a thickened proximal end to give a ring pull 300.

Figure 16:
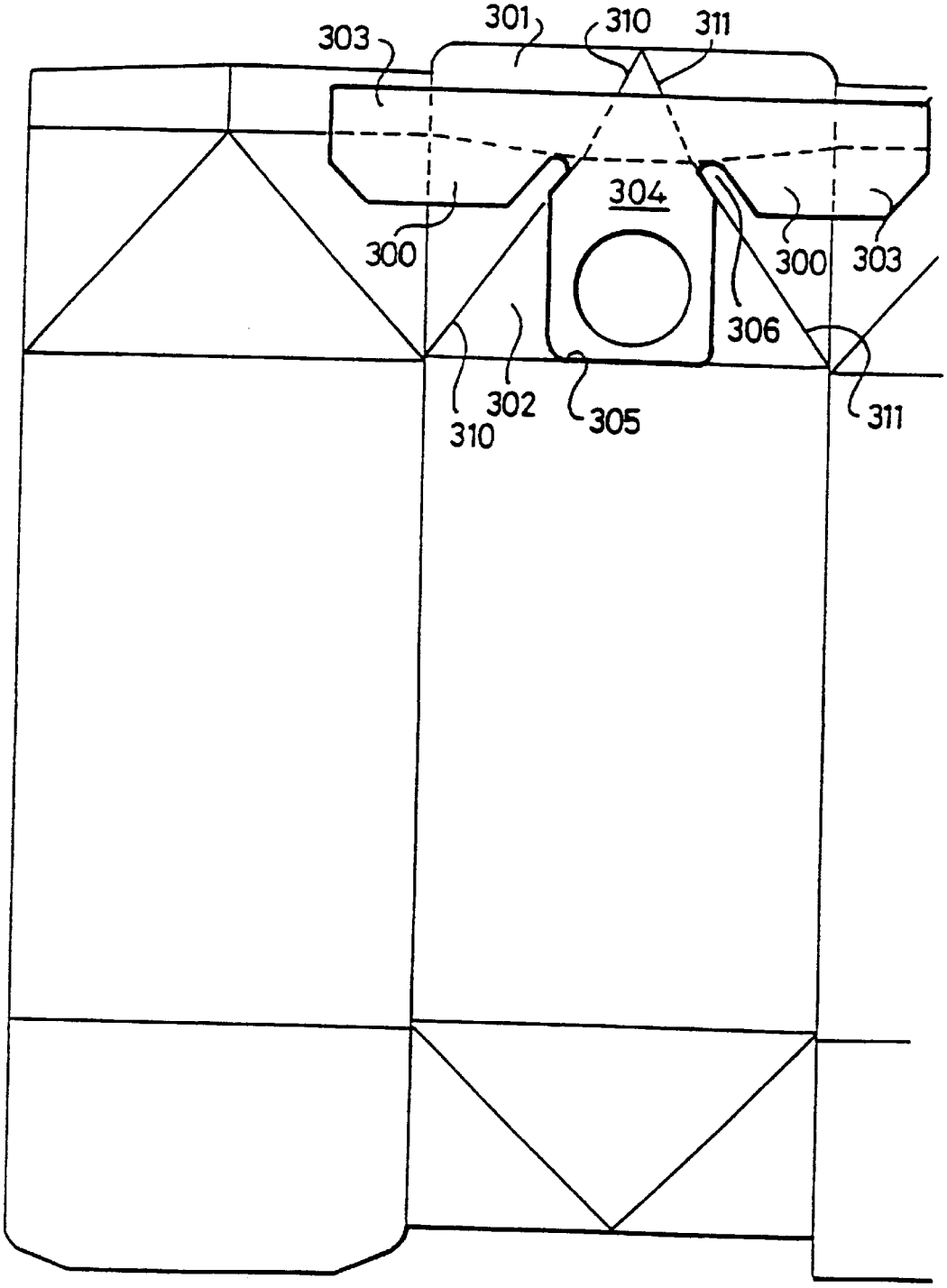

FIG. 16 shows a further alternative form of pull tab mounted upon a blank used to form a container. In this form of pull tab, the feet 300 of the pull tab extend axially over the side wall of the ridge 301 and over part of the adjacent tent side wall 302 of the container when assembled from the blank. The lateral extensions 303 of the feet 300 extend beyond the ends of the ridge and into the V folds of the gabled end of the assembled container. As shown, the blank has fold lines 310 and 311 formed in it extending from the mid-point of what will be the upper edge of the ridge seal down to the outer corners of what will be the base of the tent side wall 302. The shank 304 and head 305 of the pull tab are located within the resultant triangle of material bounded by the fold lines 310 and 311. The pull tab is provided with stress relief curves 306 at the intersections of the shank 304 and the feet 300 which also allow the head 305 to be lifted away from the face of the tent side wall 302 for gripping by a user. The pull tab is secured to the blank by heat sealing the feet 300 and the extensions 303 to the blank using a heat sealer die. if desired, the pull tab can be secured in position using adhesive.

What is claimed is:

1. In boxed end openable container containing material to be dispensed from the container, which container comprises;

a. at least four contiguous axially extending panels of a wall material linked together in side by side relationship so as to form a generally tubular member have a longitudinal axis;

b. the generally tubular member having at least two substantially diametrically opposed first side walls and at least two other, second, side walls and radially inner and outward faces to the wall material of the side walls and having a first top end portion and a second bottom end portion;

c. the bottom end portion of the tubular member being formed with a transverse closure which acts as a closed bottom to the container;

d. the two said opposed first side walls in the top portion of the tubular member being indented inwardly towards the longitudinal axis of the tubular member so as to form a V fold in the top end of each of these opposed first side walls with the outer faces of the portions of the wall material within each of the V folds in contact with one another, the V folds each having an apex which is directed towards the apex of the other V fold whereby the top end of each of the second side walls of the end portion are brought into engagement with the V folds so as to form a linear ridge structure comprising the top ends of the first and second side walls in a side by side relationship to one another, the ridge structure having a portion located intermediate the apices of the V folds;

e. at least part of the outer faces of the wall material of the V folds and the inner faces of the wall material of the V folds and of the second side walls being adhered together in the ridge structure so as to form a transverse fluid tight ridge seal closure to the top of the container, which seal is to permit dispensing of material from the container;

the improvement which comprises securing a pull tab to the outer face of at least one of the said second side walls in the end portion of those walls, which pull tab at rest comprises:

i. a shank member extending axially between a proximal end adapted to be gripped and pulled by a user and distal end secured to the material of the top end portion of the second wall of the container;

ii. at least one foot member extending laterally and substantially symmetrically to each side from said distal end of the shank member in substantially the same plane as the shank member and securing the distal end of the said shank member to the top end portion of the second wall of the container; and iii. at least one extension to each of said foot members extending in a direction relative to the longitudinal axis of the shank member selected from axially and laterally, said extensions being in substantially the same plane as said foot members; and iv. said pull tab being secured to the end portion of the second wall of the container with the shank member substantially in axial register with the portion of the ridge structure intermediate the apices of the V folds, whereby a force for separating the adherence of the faces in the linear ridge seal can be applied by a user gripping and pulling the pull tab so as to separate at least part of the ridge seal without tearing or otherwise rupturing the second side wall of the container to which the pull tab is secured.

2. A container as claimed in claim 1, wherein the said extension extends axially and proximally of the foot member.

3. A container as claimed in claim 1, wherein the said extension extends axially and distally of the foot member.

4. A container as claimed in claim 1, wherein said extension extends laterally and axially of the foot member.

5. A container as claimed in claim 1, wherein the foot member is made from a material which is thermally fused to the material of the outer face of said second wall.

6. A container as claimed in claim 1, wherein the pull tab is made from a laminate of a polyethylene and a polyester.

7. A method for opening the container of claim 1, which method comprises gripping and pulling the proximal end of the shank of the pull tab of the container so as to apply a separating force to the linear ridge seal so as to separate the adhesion between the adhered surface of at least part of the ridge seal without tearing or otherwise rupturing the side wall, and simultaneously cause the side wall to which the pull tab is secured to bow outwardly so as to form an outlet to the container.

8. A method as claimed in claim 7, wherein the linear ridge seal is bowed to direct the lateral ends of the ridge seal away from the wall to which the pull tab is secured and to direct the portion of the ridge seal intermediate the ends of the apices of the V folds towards the wall to which the pull tab is secured, and pulling the pull tab in a direction away from the bowed ridge seal.

9. A blank for use in the manufacture of a container as claimed in claim 1, which blank comprises a. A planar member formed from at least four contiguous axially extending panels of a wall material linked together in side by side walls of the tubular member of the container, a first two of said panels to provide the said first side walls of the container whose top end portions are to be indented to form said V folds and a second two of said panels which are to form said second side walls of the container, one of said second panels being located intermediate said two first panels; and b. A pull tab secured to said one of said second panels, the pull tab comprising at rest i. A shank member extending axially between a proximal end adapted to be gripped and pulled by a user and a distal end secured to the material of the top end portion of the said second panel;

ii. at least one foot member extending laterally and substantially symmetrically to each side from said distal end of the shank member in substantially the same plane as the shank member and securing the distal end of the said shank member to the top end portion of the said second panel; and iii. At least one extension to each of said foot members extending in a direction relative to the longitudinal axis of the shank member selected from axially and laterally, said extensions being in substantially the same plane as said foot members; and said pull tab being secured to the end portion of the said second panel with the shank member substantially in axial register with the center line of the panel.

10. A method for making a blank as claimed in claim 9, wherein the feet of the pull tab are located at the desired position on the said second panel and secured in position by heat sealing the material of the feet to the wall material of the said panel.

* * * * *